US006736336B2

(12) United States Patent
Wong

(10) Patent No.: US 6,736,336 B2
(45) Date of Patent: May 18, 2004

(54) SHOWER HEAD

(75) Inventor: Kwok Din Wong, Kowloon Bay (HK)

(73) Assignee: International Concepts, Inc., St. Joseph, MI (US)

( * ) Notice: Subject to any disclaimer, the term of this patent is extended or adjusted under 35 U.S.C. 154(b) by 69 days.

(21) Appl. No.: 09/975,654

(22) Filed: Oct. 11, 2001

(65) Prior Publication Data

US 2002/0113145 A1 Aug. 22, 2002

Related U.S. Application Data

(60) Provisional application No. 60/240,237, filed on Oct. 13, 2000.

(51) Int. Cl.[7] ..... B05B 15/00

(52) U.S. Cl. ..... 239/446; 239/104; 239/106; 239/123; 239/380; 239/381; 239/440

(58) Field of Search ..... 239/104, 106, 239/114, 115, 116, 117, 118, 123, 380, 381, 436, 437, 440, 446, 441, 462, 548, 553, 567, 575

(56) References Cited

U.S. PATENT DOCUMENTS

| | | | | |
|---|---|---|---|---|
| 2,251,192 A | | 7/1941 | Krumsiek et al. | |
| 3,958,756 A | | 5/1976 | Trenary et al. | |
| 4,190,207 A | | 2/1980 | Fienhold et al. | |
| 4,306,521 A | | 12/1981 | Giles | |
| 4,588,130 A | | 5/1986 | Trenary et al. | |
| 4,598,866 A | | 7/1986 | Cammack et al. | |
| 4,657,185 A | * | 4/1987 | Rundzaitis | 239/438 |
| 4,838,486 A | | 6/1989 | Finkbeiner | |
| 5,033,897 A | * | 7/1991 | Chen | 401/281 |
| 5,172,862 A | * | 12/1992 | Heimann et al. | 239/114 |
| 5,316,216 A | | 5/1994 | Cammack et al. | |
| 5,718,380 A | | 2/1998 | Schorn et al. | |
| 5,765,760 A | * | 6/1998 | Kuo | 239/440 |
| 5,772,119 A | * | 6/1998 | Someya et al. | 239/315 |
| 5,830,360 A | | 11/1998 | Mozayeni | |
| 5,833,138 A | | 11/1998 | Crane et al. | |
| 6,230,988 B1 | * | 5/2001 | Chao | 239/394 |
| 6,341,737 B1 | * | 1/2002 | Chang | 239/394 |

OTHER PUBLICATIONS

Advertisement, "A Spa Experience", Teledyne Water Pik, 1999, 2 pages.

* cited by examiner

*Primary Examiner*—Robin O. Evans
(74) *Attorney, Agent, or Firm*—Baker & Daniels

(57) ABSTRACT

A shower head is disclosed having a front housing portion and a rear housing portion. Intermediate the front and rear housing portions is an integral filter canister including copper-zinc media for the removal of chlorine and other chemicals and contaminants. The shower head also has a plurality of spray openings for spraying water outwardly from the shower head, with a plurality of spray modes and patterns achievable by rotation of the front housing portion. A cleaning ring is also positioned within the front housing portion, it has a camming surface such that upon rotation of the front housing portion to change the spray modes, the cleaning ring is cammed forward to clean associated spray holes of accumulated minerals such as calcium.

30 Claims, 32 Drawing Sheets

SHOWER HEAD

BACKGROUND OF THE INVENTION

1. Field of the Invention

The subject invention relates to a shower head of the type having a plurality of water spray patterns.

2. Discussion of the Prior Art

Shower heads are well known in the art. In a shower stall, a pipe fitting normally protrudes through a wall and has external threads at the end of the pipe. A shower head will threadably engage with the pipe to accept water from the pipe and provide a spray to a person using the shower. Two types of shower heads are known in the art. The first type is a fixed shower head which threadably engages to the fitting and sprays water downwardly. The second type is the hand-held wand version, where a corrugated and flexible pipe is connected to the incoming water fitting and allows the user to hold a wand in his or her hand to direct the water for the shower.

One of the concerns in this area is cleanliness, both the cleanliness of the water projecting from the shower head, but also keeping the shower head itself clean such that all spray openings of the shower head remain open for water spray. With respect to the filtration of the water, there appears to be no shower heads available having an internal filter to filter the water prior to exiting the shower head. With respect to keeping the spray apertures clean, this is at least an area that has attempted to be resolved, as shown in U.S. Pat. No. 5,718,380, yet uses the water pressure itself to drive a cleaning device.

Other desirabilities exist in this market place, including providing a plurality of spray patterns or functions, including such functions as the standard spray, a misting function, and a massage function. It is also desirable to easily change these settings from one function to the other without great difficulty. Some units exist in the market place, but have a plurality of dials for changing the functions, or require multiple dials to be operated to achieve one function. It is desirable then to provide an easy and consistent method of changing one function setting to the next.

SUMMARY OF THE INVENTION

The above shortcomings and others have been improved upon by providing a shower head for spraying water on the user, where the shower head is comprised of a front housing portion having a plurality of water spray openings, and a rear housing portion which receives incoming water from a source, and an integral filter positioned intermediate said front and rear housing portions. In this manner, water is filtered from the water source prior to being sprayed through the plurality of water spray openings.

The shower head can be profiled such that the rear housing portion has a rear port for receiving the water with internal pipe threads for a fixed connection with a water supply. Alternatively, the shower head can be profiled such that the rear housing portion includes a handle portion, and elongate flexible hose for connection with a water supply, whereby the handle and shower head can be hand-held.

Preferably the filter is defined as a cylindrical canister, filled with a filter medium comprised of copper-zinc crystals. Also preferably, the rear housing portion includes a rear filter retainer having a water flow inlet to the filter while the front housing portion includes a front filter retainer having a water flow outlet from the filter.

Preferably the shower head includes a plurality of water spray openings which are profiled in a plurality of spray patterns. Also preferably, the shower head includes a rotatable water flow director, which rotates to direct water to areas defining said spray patterns.

In another aspect of the invention, a shower head comprises a plurality of water spray openings and a front face plate of the shower head, where the openings are profiled to define different spray modes operable by rotating the front face. The shower head has a rotatable water flow director which rotates with said front face upon rotation, and the water flow director directs water to various spray openings within the shower head to vary the spray mode. Preferably the front face plate includes a plurality of channels on a rear side thereof and the water flow director is rotatable to direct water to various channels. In this embodiment, the channels are defined as concentric channels of various radii. Also, the shower head includes an internal wall having at least one opening therethrough, with the water flow director having a plurality of openings, whereby rotation of the water flow director aligns at least one of the water flow director openings with the internal wall opening to direct the water flow. Also preferably, the water flow director is comprised of a plate, having a plurality of openings adjacent to the wall and having internal passageways communicating with apertures adjacent to the channels, with an aperture for each channel.

Preferably the shower head internal wall includes more than one opening, and a plurality of the water flow director openings can be aligned with the internal wall openings, whereby a plurality of spray modes operate simultaneously. Finally, the shower head preferably includes an internal filter positioned adjacent the internal wall, whereby water is directed through the filter and then through the internal wall opening.

In yet another embodiment of the invention, a shower head for spraying water includes a plurality of spray openings and front face plate, and a cleaning ring positioned behind the face plate with a plurality of cleaning pins aligned with the plurality of spray openings. A camming surface is positioned on the cleaning ring, whereby the front face plate and cleaning ring are rotatable and the cleaning ring is cammed forward projecting the cleaning pins through the spray openings.

Preferably the cleaning ring is spring-loaded in the fully rearward position away from the front face plate. Also preferably, the face plate has a plurality of detented positions, where the cam is profiled to traverse a complete cycle between adjacent detented positions.

In yet another embodiment of the invention, a shower head includes a front face plate having a plurality of spray openings defining a plurality of spray patterns, a water distributor directing the flow of water between select spray patterns and a filter positioned upstream of the front face plate to filter water prior to exiting from the face plate. In the preferred embodiment of the invention, the front face plate is rotatable to vary the spray patterns, and a cleaning ring is positioned behind the face plate with cleaning pins moving into and out of at least some of the openings, upon rotation of the face plate.

DETAILED DESCRIPTION OF THE PREFERRED EMBODIMENT

Figure 1:
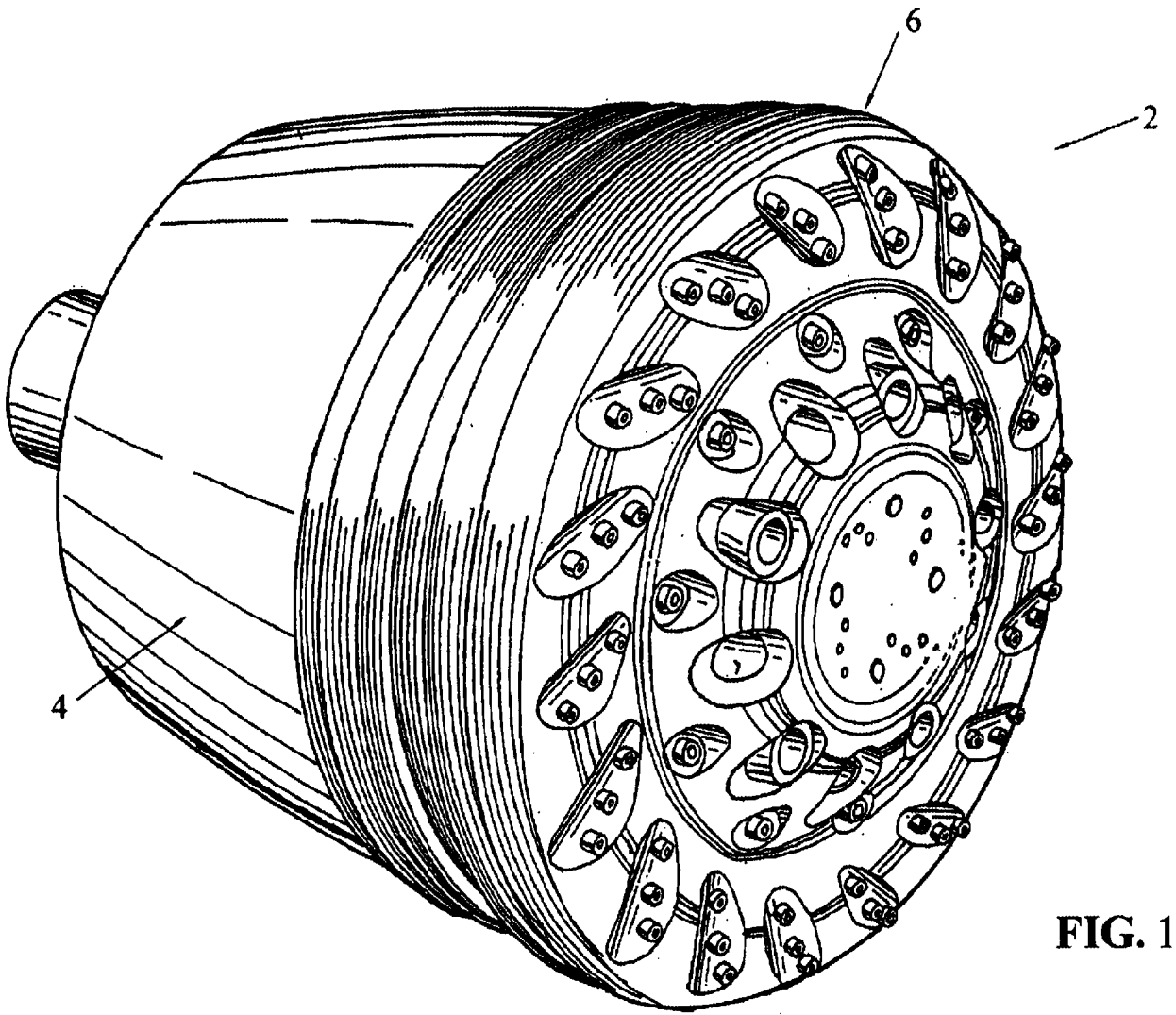
FIG. 1 is a front perspective view of the shower head of the subject invention which is for fixed mounting within a shower.
Figure 2:
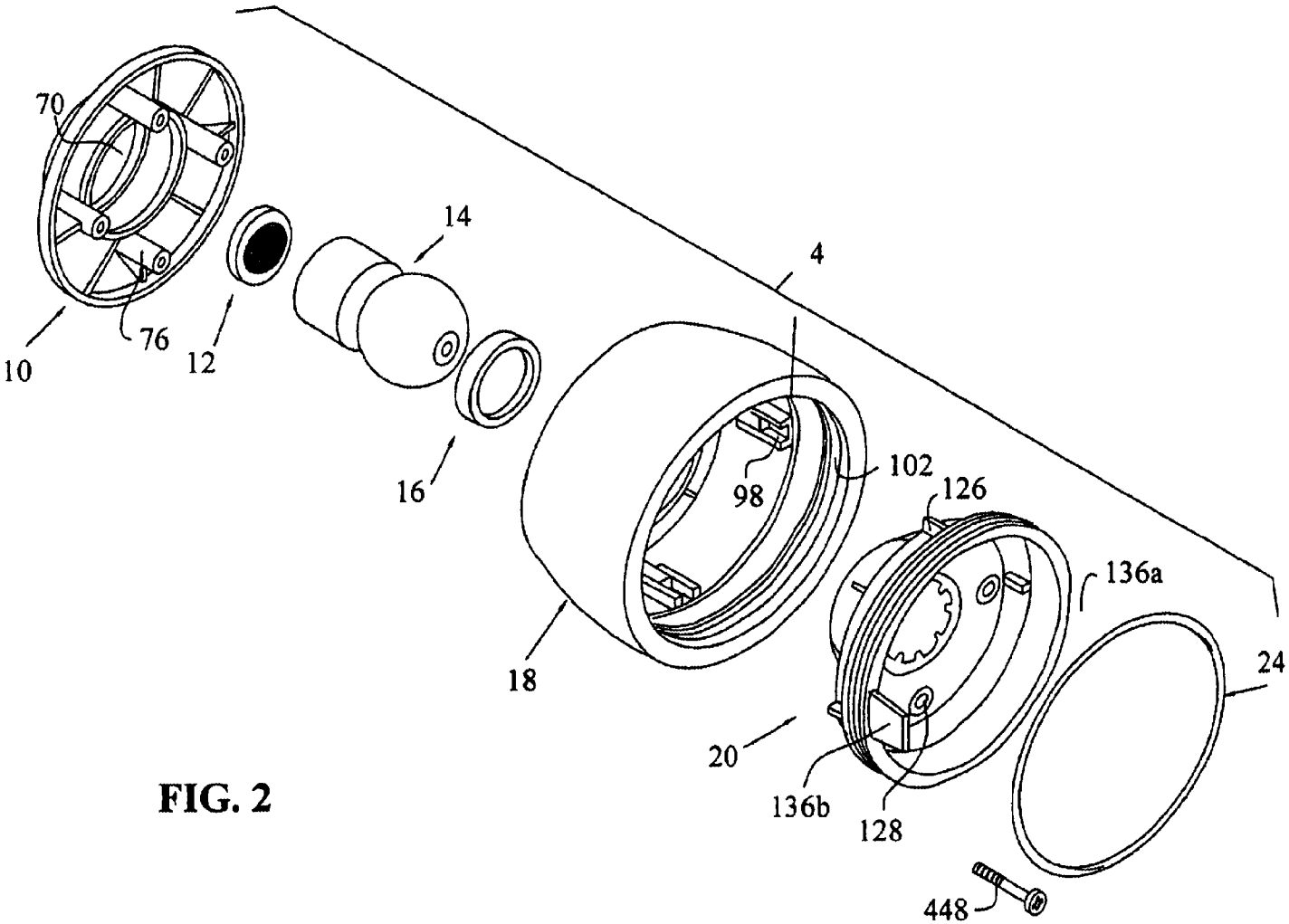
FIG. 2 is an exploded view of the rear portion of the shower head of FIG. 1.

With reference first to FIG. 1, a shower head is shown generally at 2, which comprises a rear housing portion 4 coupled to a front housing portion 6. The rear housing portion includes a threadable pipe attachment member internally threaded for pipe threads which can be threadably engaged with a pipe stub which projects from standard shower stalls. Shower head 2 is also of the type where the front housing portion 6 is rotatable to vary the manner in which the water projects from the shower head. With reference now to FIG. 2, the rear housing portion 4 will be described in greater detail.

As shown in FIG. 2, the rear housing portion 4 is generally comprised of a rear housing plate portion 10, a filter screen member 12, a pipe spigot ball joint 14, and a seal 16. The rear housing portion 4 further includes a housing skirt portion 18 which accepts a rear filter retainer 20 having an O-ring seal 24. The specific details of each of the components of rear housing portion 4 shall be described in greater detail herein.

Figure 3:
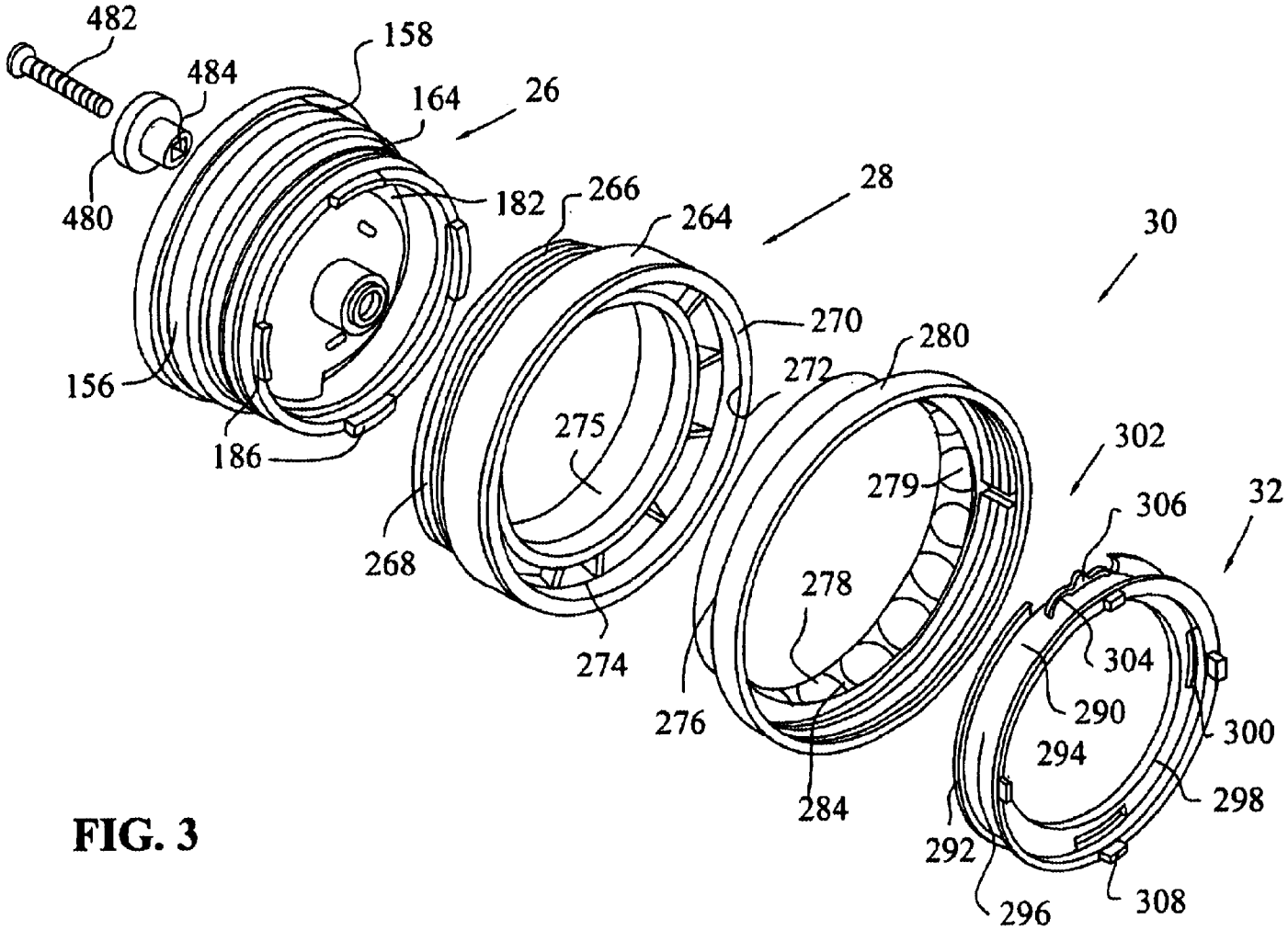
FIG. 3 is an exploded view of a portion of the front portion of the shower head shown in FIG. 1.
Figure 4:
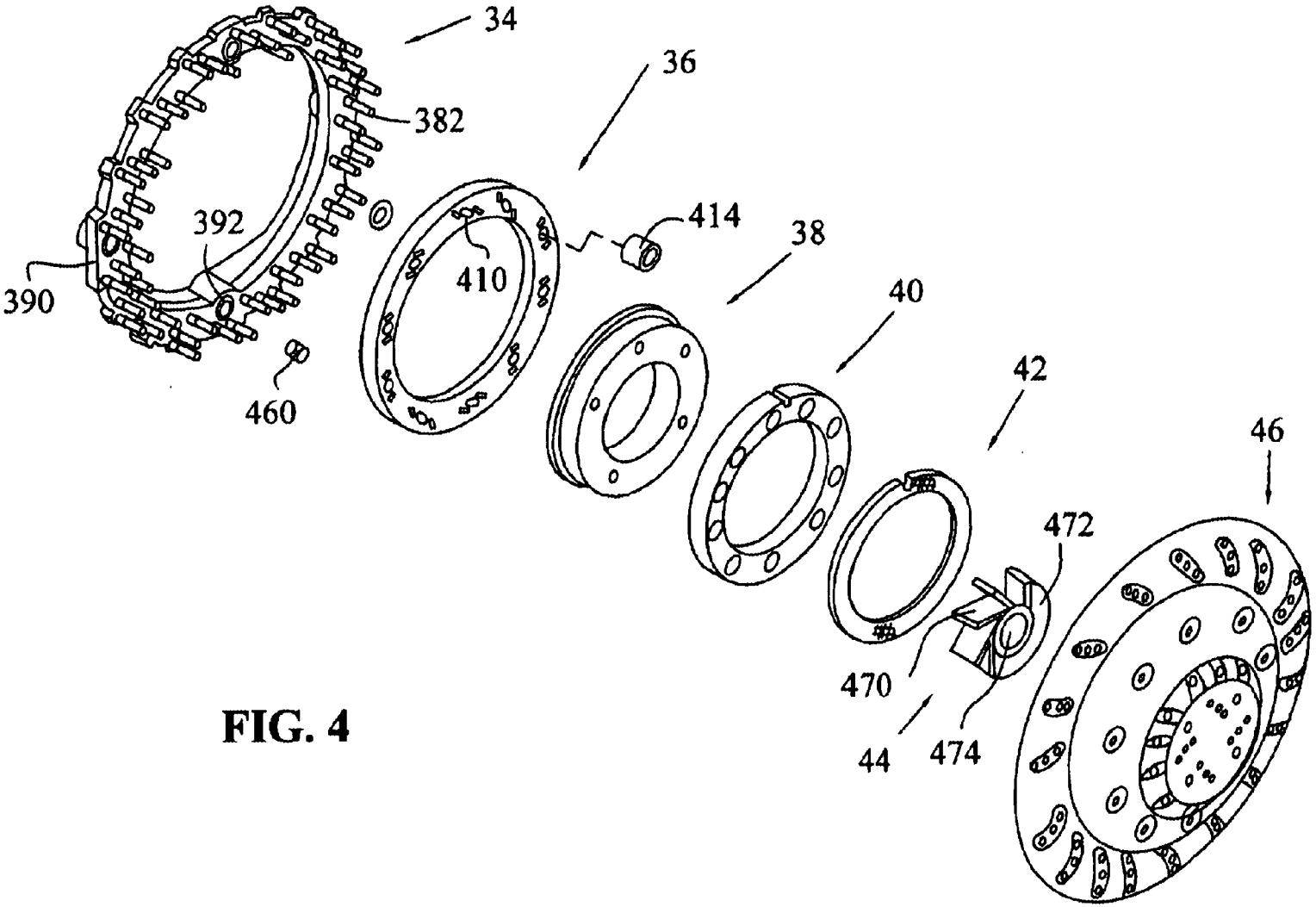
FIG. 4 is an exploded view of the components which are positioned within the front plate housing.
Figure 5:
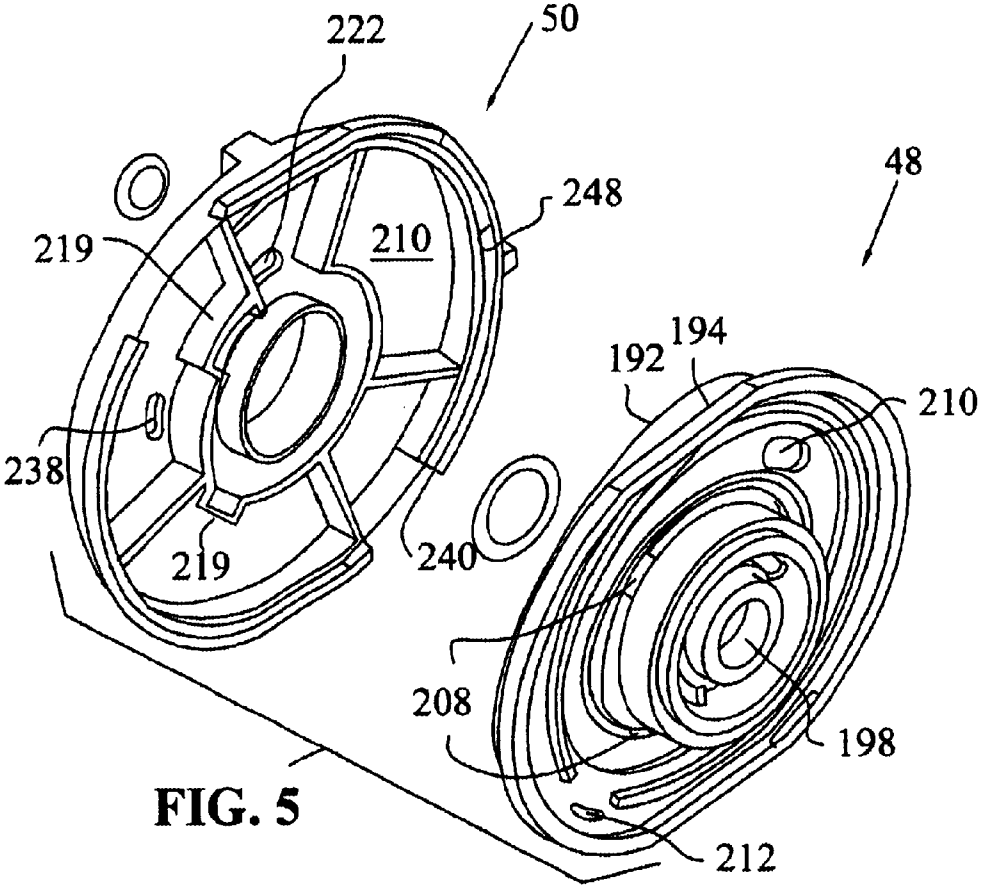
FIG. 5 is an exploded view of the rotatable water flow controller usable in the subject invention.
Figure 6:
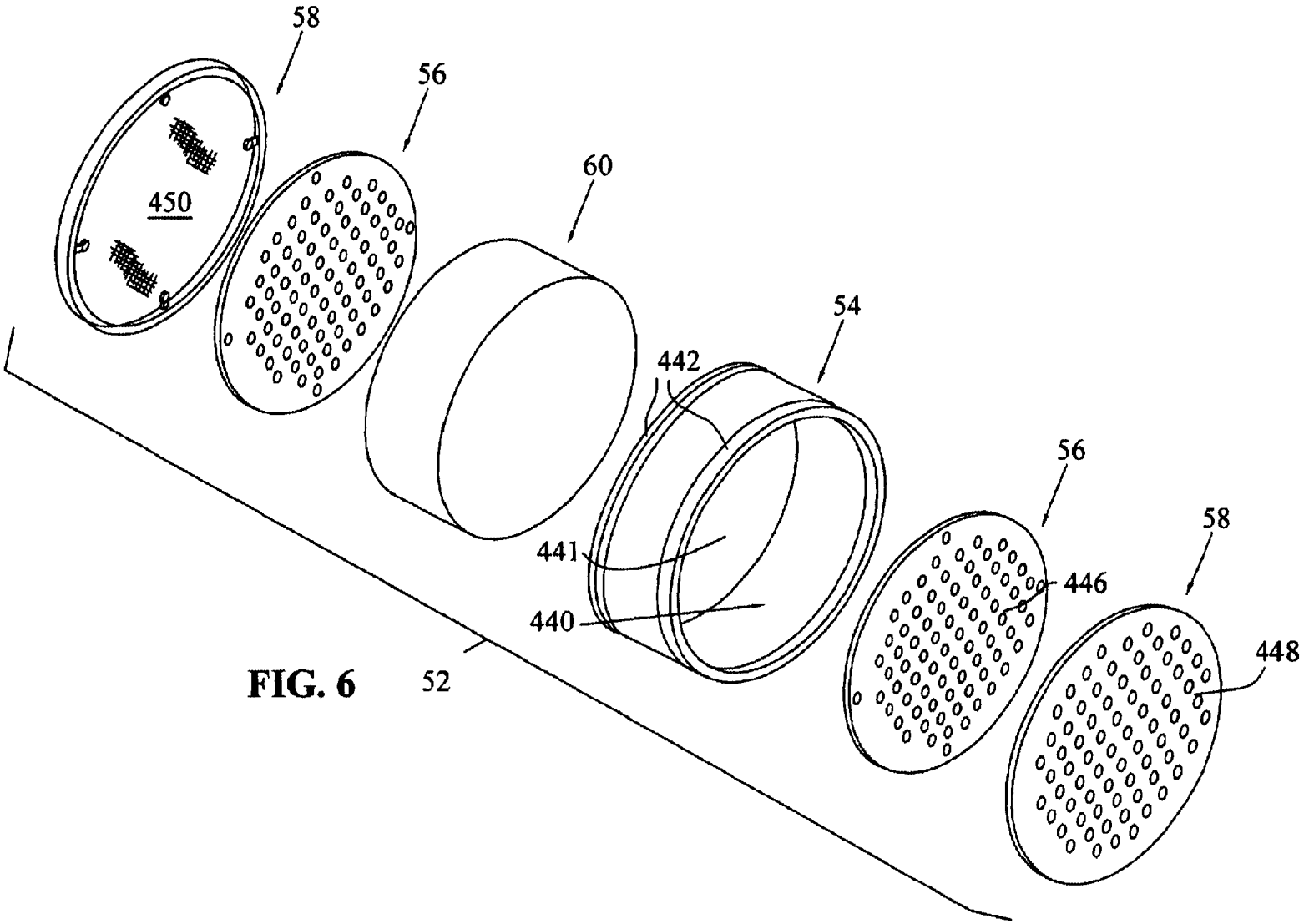
FIG. 6 is an exploded view of the integral filter pack of the subject invention.

With reference now to FIG. 3, a portion of the front housing portion is shown as including a front filter retainer 26, a thread ring 28, an outer ring 30, and a seal retainer ring 32. Another portion of the forward housing assembly is shown in FIG. 4 as including a cleaning ring 34, atomizer ring 36, flow rings 38 and 40, screen ring 42, massage turbine wheel 44, and front face plate 46. Finally, with respect to FIG. 5, the front body section is completed by the inclusion of the front and rear flow director plates 48 and 50, respectively. And as shown in FIG. 6, a filter assembly is included which is shown generally as reference numeral 52, which includes a filter body 54, intermediate caps 56, end caps 58, and filter medium 60.

Figure 7:
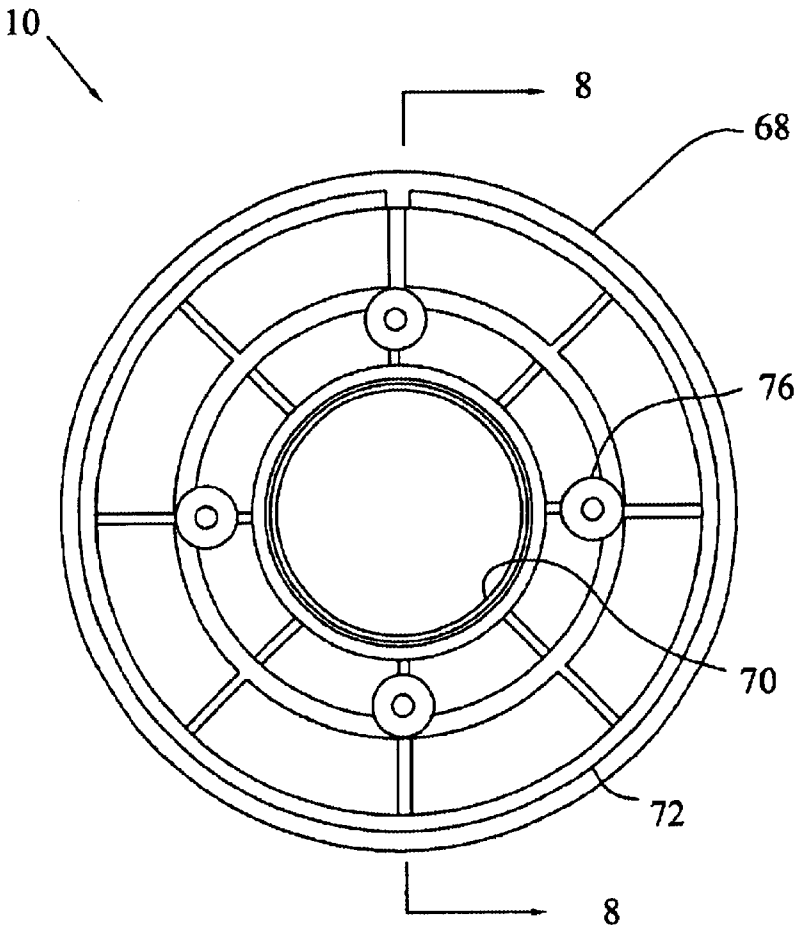
FIG. 7 is a plan view of the rear head which is shown in FIG. 2.
Figure 8:
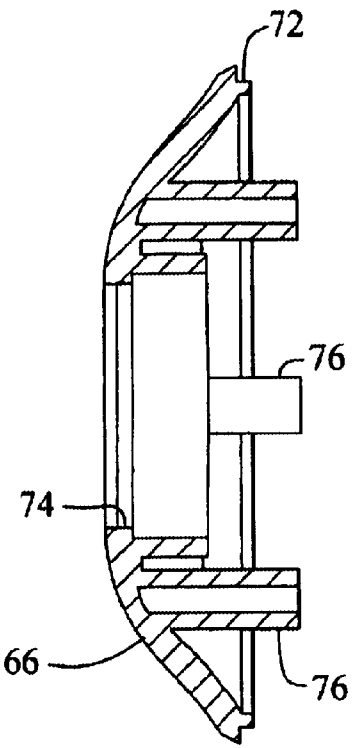
FIG. 8 is a cross-sectional view through lines 8—8 of FIG. 7.

With reference now to FIGS. 7 through 24, the specific details of each of the components of the shower head will now be described in greater detail. With respect first to FIGS. 7 and 8, the rear housing plate portion 10 will be described in greater detail. As shown in FIGS. 7 and 8, the rear housing plate portion includes a convex wall portion 66 having an outer periphery 68 and a center through-hole at 70. The outer periphery 68 is undercut to define a recessed shoulder at 72. The center through-hole 70 has a radius section at 74 profiled to receive the pipe spigot ball joint.

Finally, the rear housing plate portion 10 includes upstanding posts 76 which are profiled to receive self-tapping screws as is well-understood in the art.

Figure 9:
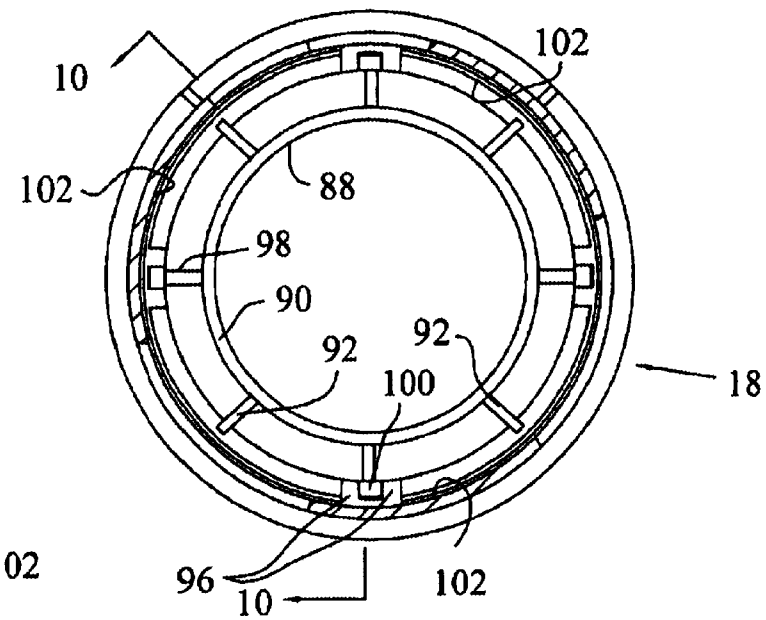
FIG. 9 shows a front plan view of the housing skirt shown in FIG. 2.
Figure 10:
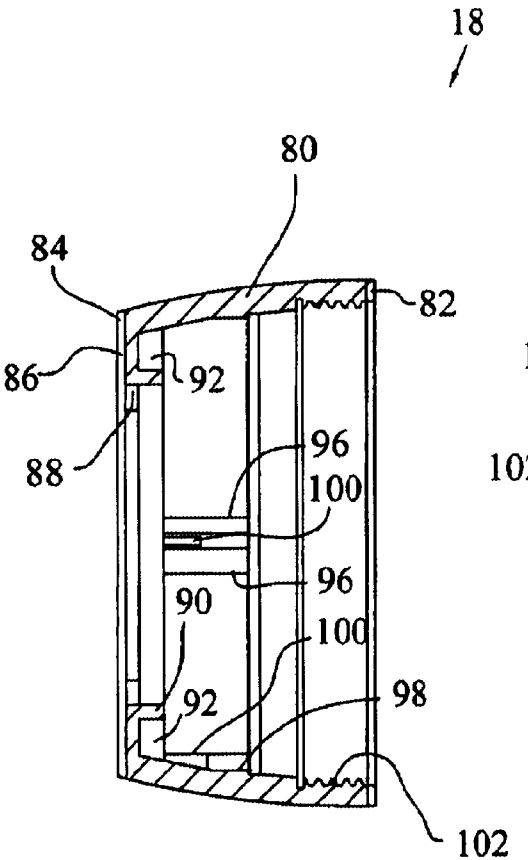
FIG. 10 shows a cross-sectional view through lines 10—10 of FIG. 9.

With reference now to FIGS. 9 and 10, the housing skirt portion 18 will be described in greater detail. The skirt portion 18 includes an outer wall 80 having a front edge 82, a rear edge 84, a recessed surface at 86, and an opening at 88. As shown in both FIGS. 9 and 10, the housing skirt portion 18 further comprises a lip 90 circumscribing the opening 88 and having radially extending ribs 92 projecting outwardly to the wall section 80 at radial locations around the wall portion 80, and as shown in FIG. 9, locating ribs 96 are positioned which define between them a receiving slot 98. At each of the locations of the locating ribs 96, are stand-offs 100 located intermediate the locating ribs 96 as will be described in greater detail herein. Finally, the skirt 18 includes threaded sections at 102 for connection with the front housing portion as further described herein.

Figure 11:
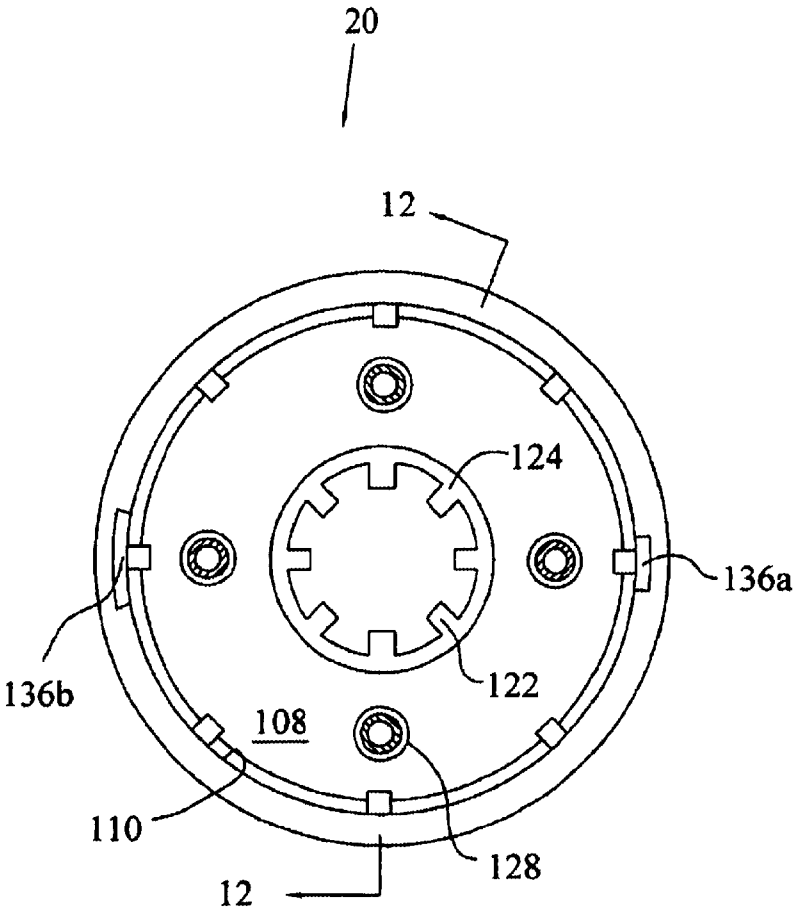
FIG. 11 is a front plan view of the rear filter retainer.
Figure 12:
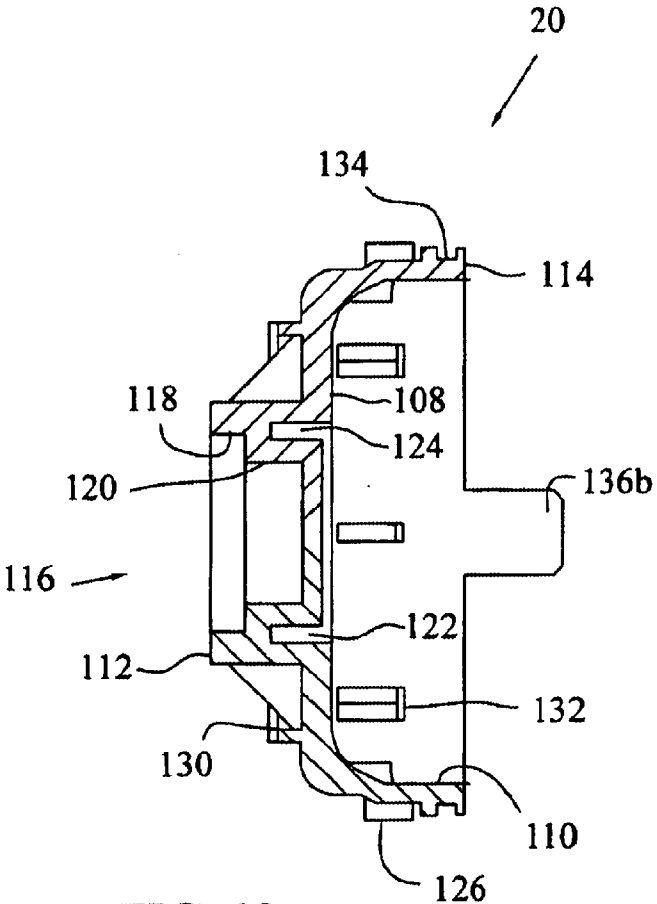
FIG. 12 is a cross-sectional view through lines 12—12 of FIG. 11.

With respect now to FIGS. 11 and 12, the rear filter retainer 20 will be described in greater detail. The rear filter retainer 20 includes a rear wall portion 108 contiguous with a peripheral wall portion 110, the rear filter retainer extending between a edge 112 and a forward edge 114. A water-flow passageway is shown generally at 116 and extends from the rear edge 112 through a front surface of the rear wall portion 108. The water passageway 116 includes a first counter bored section 118 contiguous with a second counter bored section at 120. Water-flow passages 122 are radially positioned in a plurality of locations as shown best in FIG. 11, for the flow of water into a perimetral channel 124. The rear filter retainer 20 further comprises a plurality of alignment ribs 126 on the outside of the peripheral wall 110 and have a width narrower than the receiving slot 98 between the alignment ribs 96 (FIG. 10). The rear filter retainer 20 also includes through holes 128 having a lower counter-bored section at 130 profiled with an inner diameter substantially the same as the outer diameter of the posts 76 (FIG. 8). Finally, the rear filter retainer 20 includes a plurality of filter stand-offs 132, an O-ring groove 134, and polarizing lugs 136.

Figure 14:
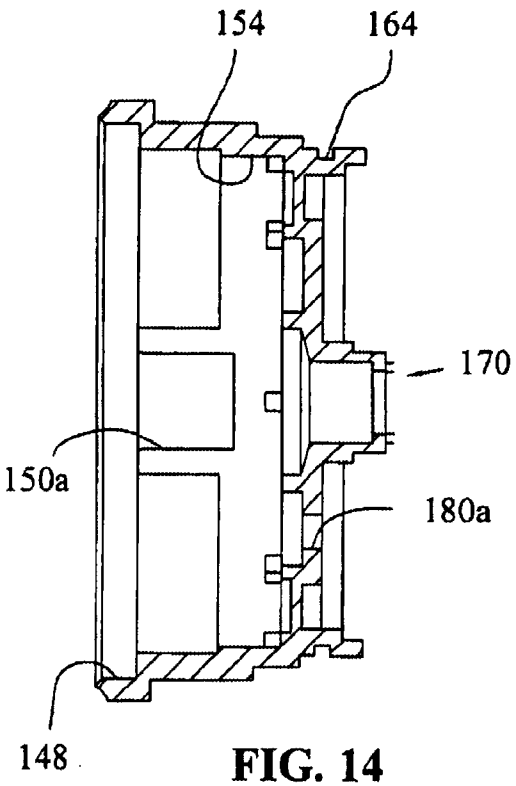
FIG. 14 is a cross-sectional view through lines 14—14 of FIG. 13.
Figure 13:
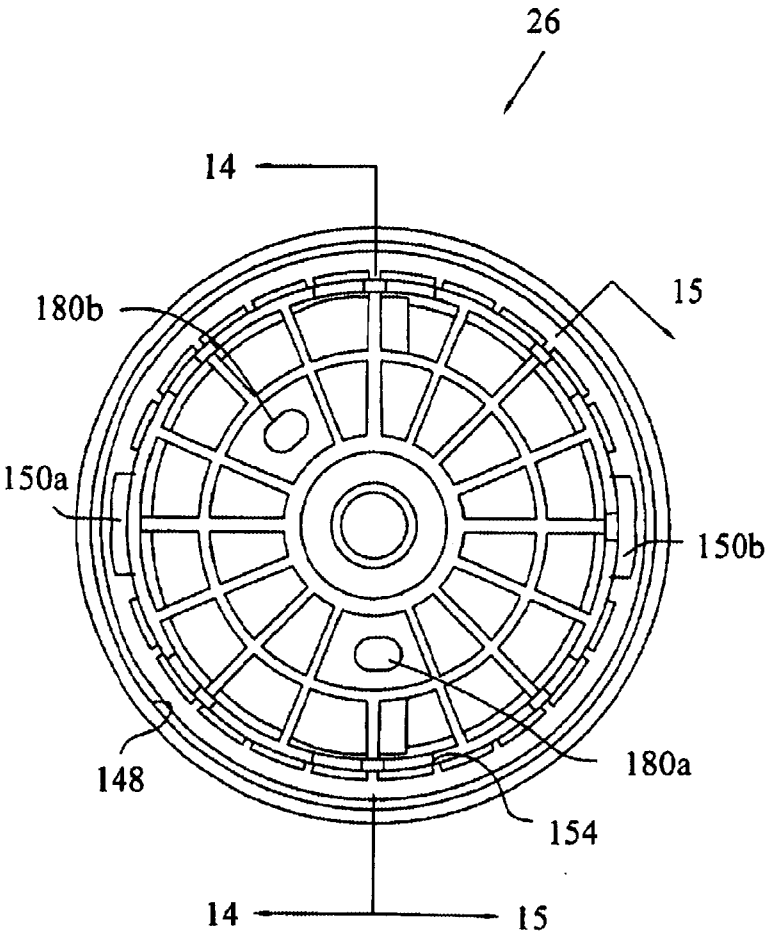
FIG. 13 is a front plan view of the forward filter retainer.
Figure 16:
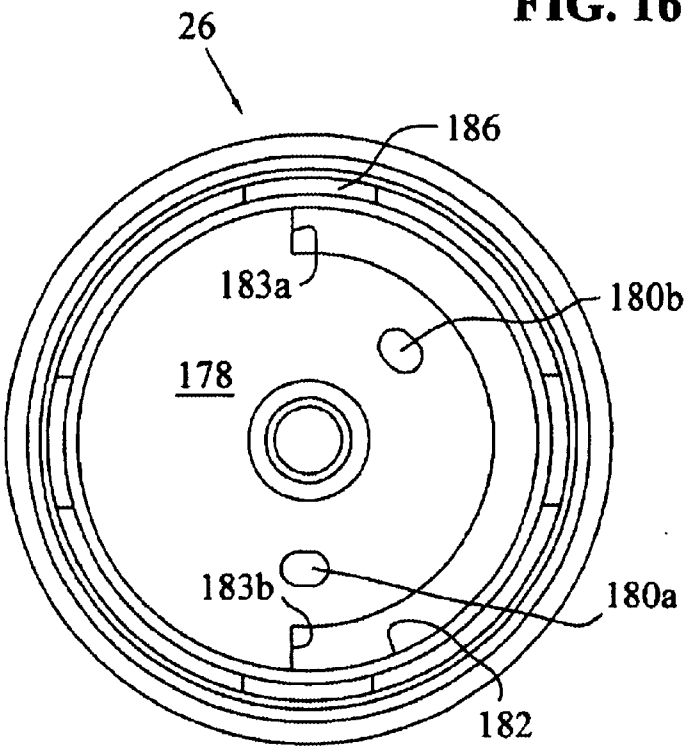
FIG. 16 is a rear plan view of the forward filter retainer of FIG. 13.
Figure 15:
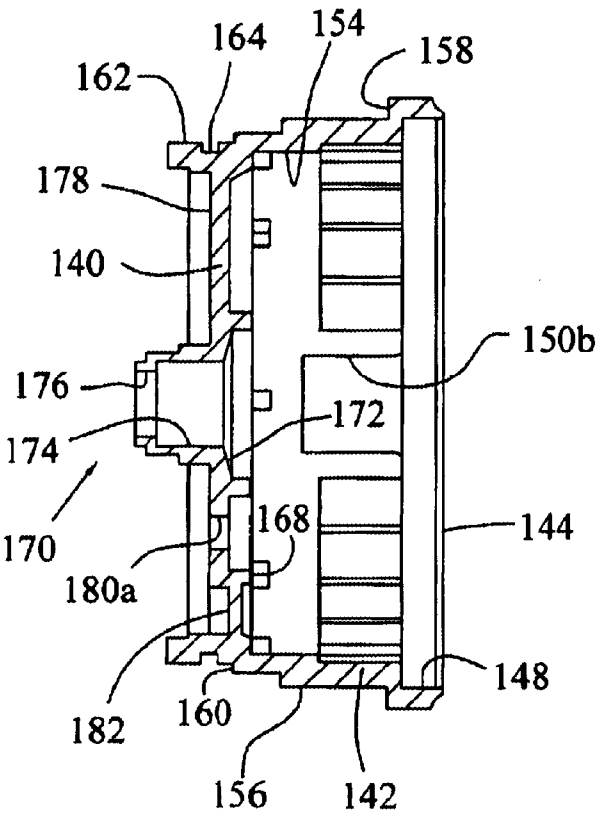
FIG. 15 is a cross-sectional view through lines 15—15 of FIG. 13.

With respect now to FIGS. 13 through 16, the front filter retainer 26 will be described in greater detail. As shown in FIGS. 14 and 15, the retainer 26 is generally comprised of a wall portion 140 contiguous with a peripheral wall 142, where the retainer 26 generally extends between a rear edge 144 and a front edge 146. The peripheral wall 142 includes an undercut surface at 148 which forms a sealing surface, and further includes polarizing openings 150*a* and 150*b*, profiled to receive polarizing lugs 136*a* and 136*b*, respectively. The wall 142 includes inner diameter section 154 and an outer diameter section at 156 forming an abutment surfaces 158, 160. Peripheral wall 142 further includes outer diameter surface 162 having an O-ring groove 164. The wall portion 140 includes stand-offs 168 and an opening shown generally at 170. The opening 170 includes a chamfered and counter-bored section at 172 leading into a central bore section 174, which ultimately results in a necked-down bore 176. As shown in FIG. 16, the front face 178 includes water passageways 180*a* and 180*b* extending entirely through the wall 140. Wall 140 further includes a semi-circular channel 182 extending around the inside diameter 184, having end walls 183*a*, 183*b*. Finally, locating lugs 186 extend forwardly from the front edge 146.

Figure 19:
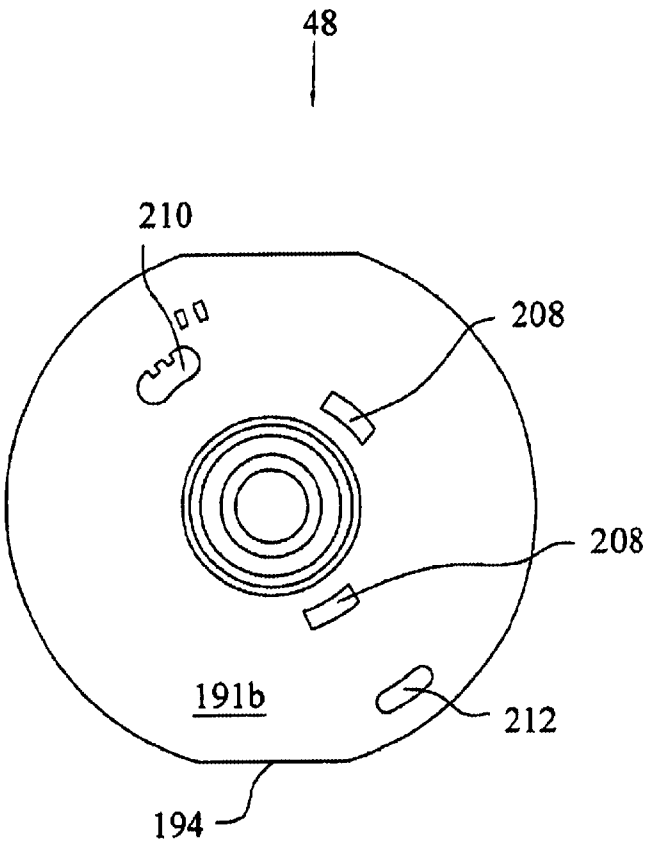
FIG. 19 is the back side plan view of the f low director plate of FIG. 17.
Figure 18:
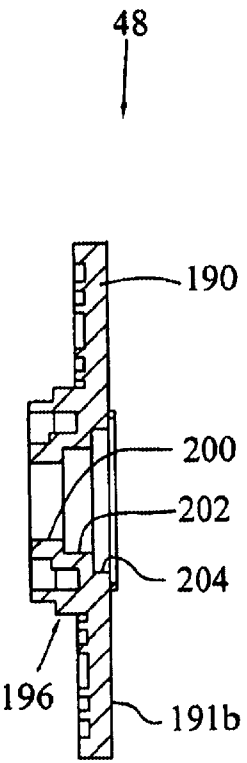
FIG. 18 is a cross-sectional view through lines 18—18 of FIG. 17.
Figure 17:
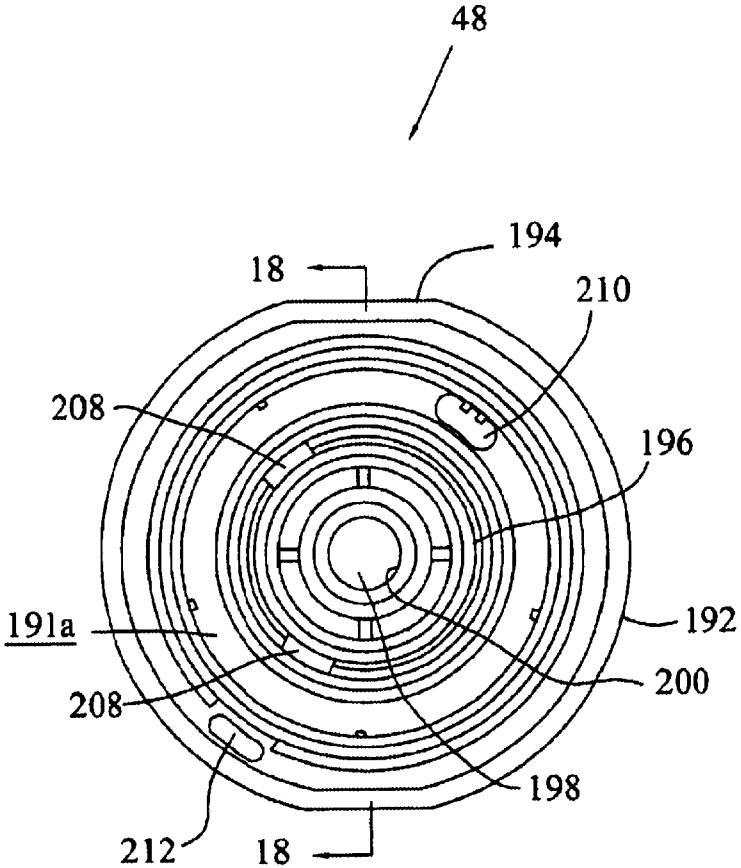
FIG. 17 is a front plan view of the front water flow director plate.

With respect now to FIGS. 17–19, the front flow director plate 48 will be described in greater detail. The plate 48 is generally comprised of a central wall section 190 having a front face 191*a*, a rear face 191*b* and an outer periphery at 192 which has flattened sections 194. The wall 190 further includes a central bearing section 196 having an opening 198 extending therethrough, including bore sections 200, 202, and 204. The plate 48 further includes a plurality of water passageways at 208, 210, and 212.

Figure 20:
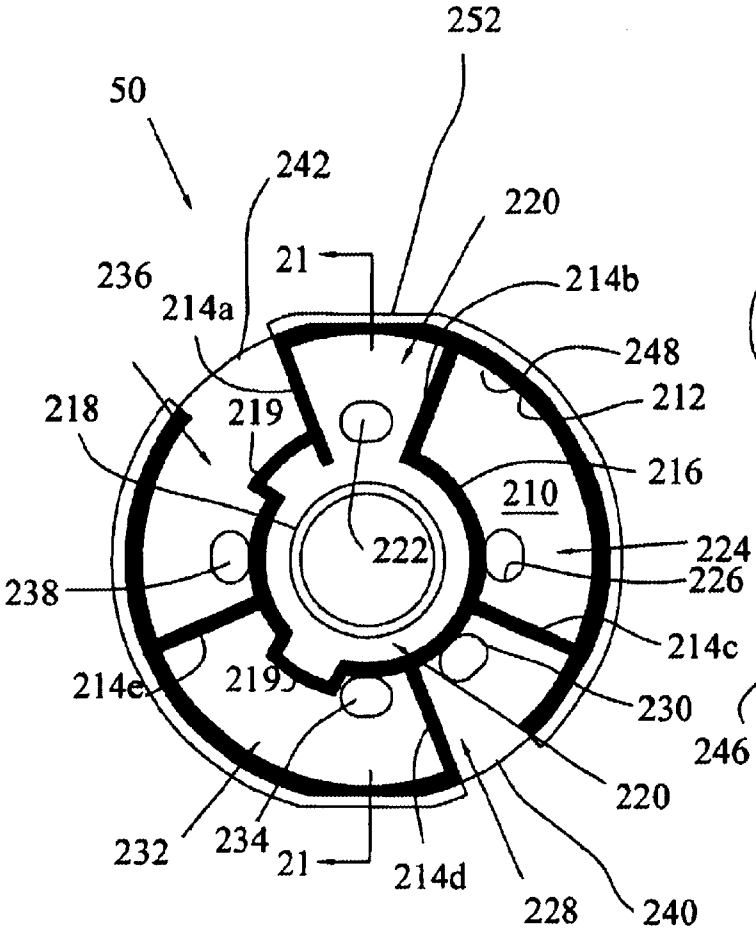
FIG. 20 is a front plan view of the rear water flow director plate.

With respect now to FIGS. 20–22, the rear flow director plate 50 will be described in greater detail. The plate 50 is generally comprised of a central wall portion 210 having a peripheral wall portion 212. The plate 50 includes a plurality of partition wall sections 214*a*–214*e*, and coaxial walls 216, 218 defining a plurality of water flow chambers. Peripheral wall 216 further includes key hole partitions at 219 to complete the water flow chamber. More specifically, partition walls 214*a* and 214*b*, together with the coaxial walls 216, 218 define a water chamber 220 having an opening 222. Partition walls 214*b*, coaxial wall 216 and partition wall 214*c* define a water chamber 224 having a water opening 226. Partition wall 214*c*, coaxial wall 216 and partition wall 214*d* define a water chamber 228 having a water opening 230. Partition wall 214*d*, coaxial wall 216 and partition wall 214*e* define a water chamber 232 having a water opening 234. And finally, partition 214*e*, coaxial wall 216 and partition wall 214*a* define a water chamber 236 having an opening 238. It should be appreciated that the water chambers 228 and 236 have radial openings 240 and 242 formed by the discontinuation of the outer peripheral wall 212 for a short section intermediate the partition walls 214*c* and 214*d*; and partition walls 214*a* and 214*e*, respectively. Furthermore, the top edge of each wall 212, 214, 216, 218 includes a tapered rib 246, while the outer periphery of wall 212 includes an upstanding lip 248.

Figure 22:
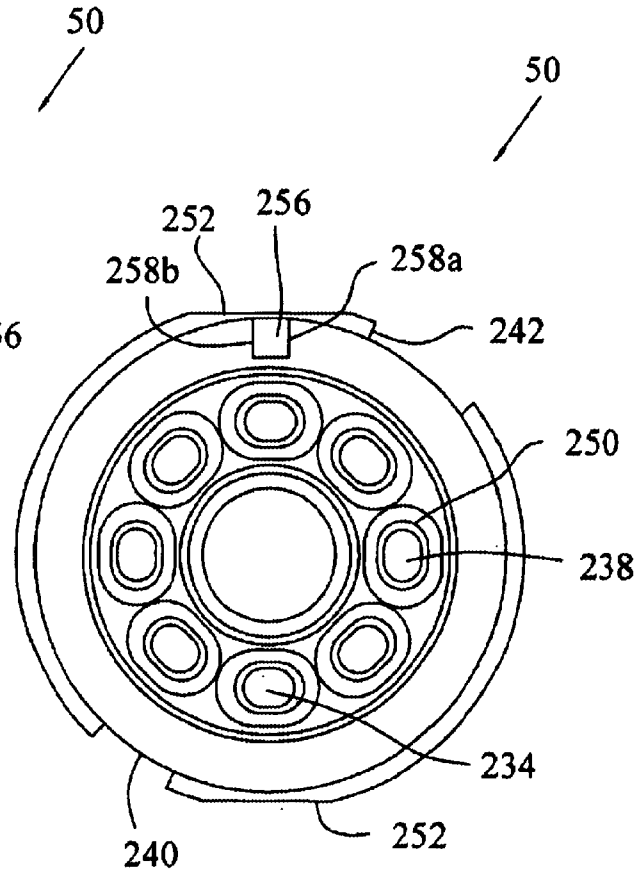
FIG. 22 is a r ear plan view of the water flow director plate of FIG. 20.
Figure 21:
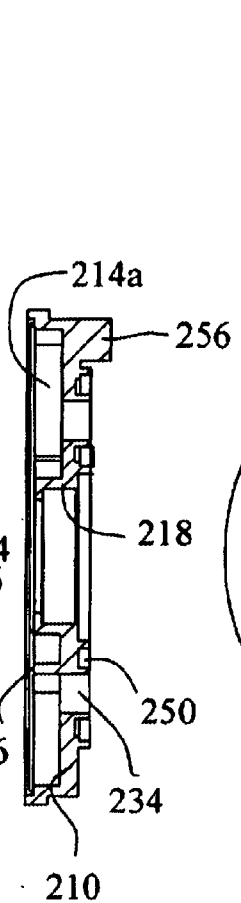
FIG. 21 is a cross-sectional view through lines 21—21 of FIG. 20.

Each of the openings 222, 226, 230, 234, and 238 includes an O-ring receiving channel 250 surrounding the respective opening as shown in FIGS. 21 and 22. The plate includes flattened edges 252 of substantially the same profile as sections 194 shown in FIG. 17. Finally, the plate 50 includes a stop lug 256 having side stop surfaces 258*a* and 258*b*.

With reference again to FIG. 3, the thread ring 28, outer ring 30, and seal retaining ring 32 will be described in greater detail. The thread ring 28 is generally comprised of a central wall section 264 having a front edge 266 which is the lead-in to threaded section 268. It should be understood that threaded section 268 is a mating thread to thread sections 102 of the skirt 18. The ring 28 further includes a rear edge 270 which leads in to an inner diameter 272 having a stop surface at 274.

Ring 30 includes a forward lip 276 having a front edge 278, an inner diameter at 279, and an outer curved ring portion 280 having an end edge 282. Inner diameter 279 has a plurality of detent channels at 284.

Seal retaining ring 32 includes a central ring portion 290 having a first annular rib 292 and a second annular rib 294 defining a seal receiving channel 296 therebetween. A central ring 298 extends integrally from the central ring portion 290 and includes a plurality of openings 300 profiled for engagement with the lugs 186 on front filter retainer 26. The ring 32 includes a detent member 302 having a spring beam 304 with a detent bead 306 extending outwardly therefrom. Finally, camming lugs 308 extending outwardly from the annular rib 294.

Figure 24:
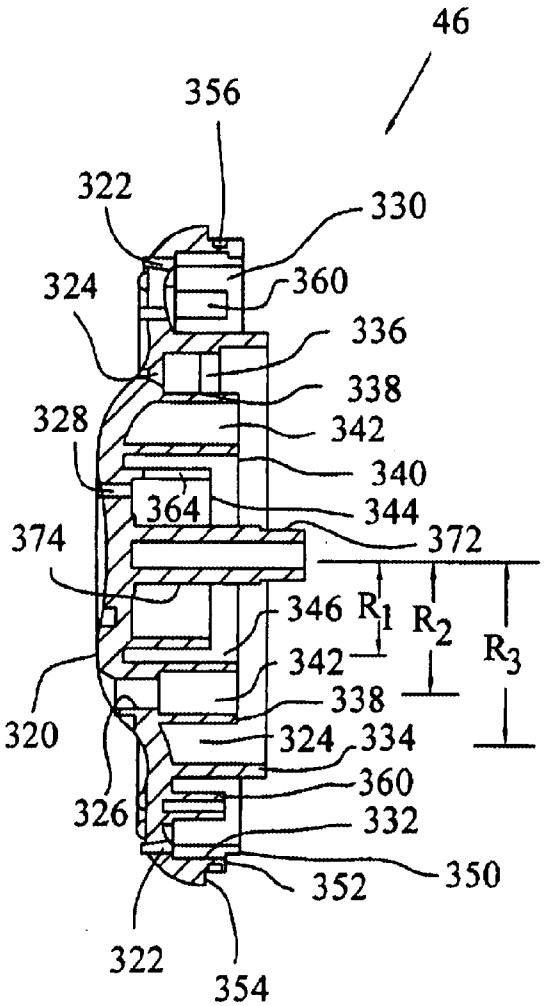
FIG. 24 is a cross-sectional view through lines 24—24 of FIG. 23.
Figure 23:
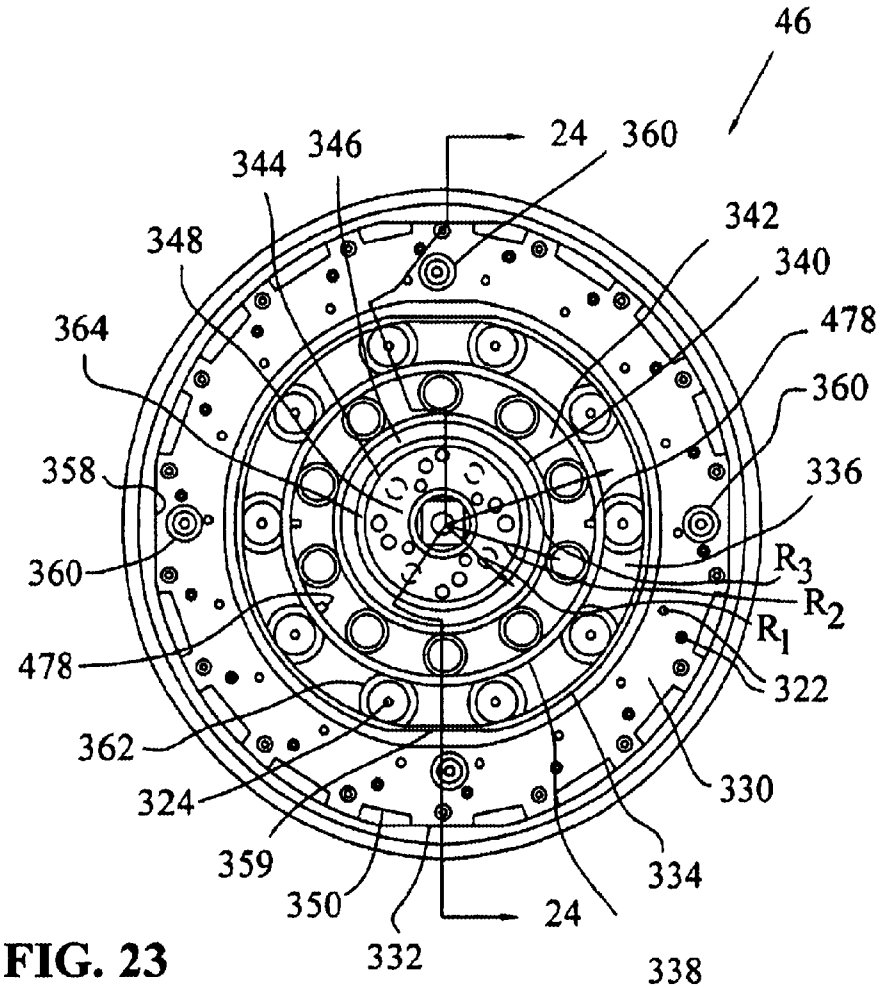
FIG. 23 is a rear plan view of the front shower head panel shown in FIG. 4.
Figure 25:
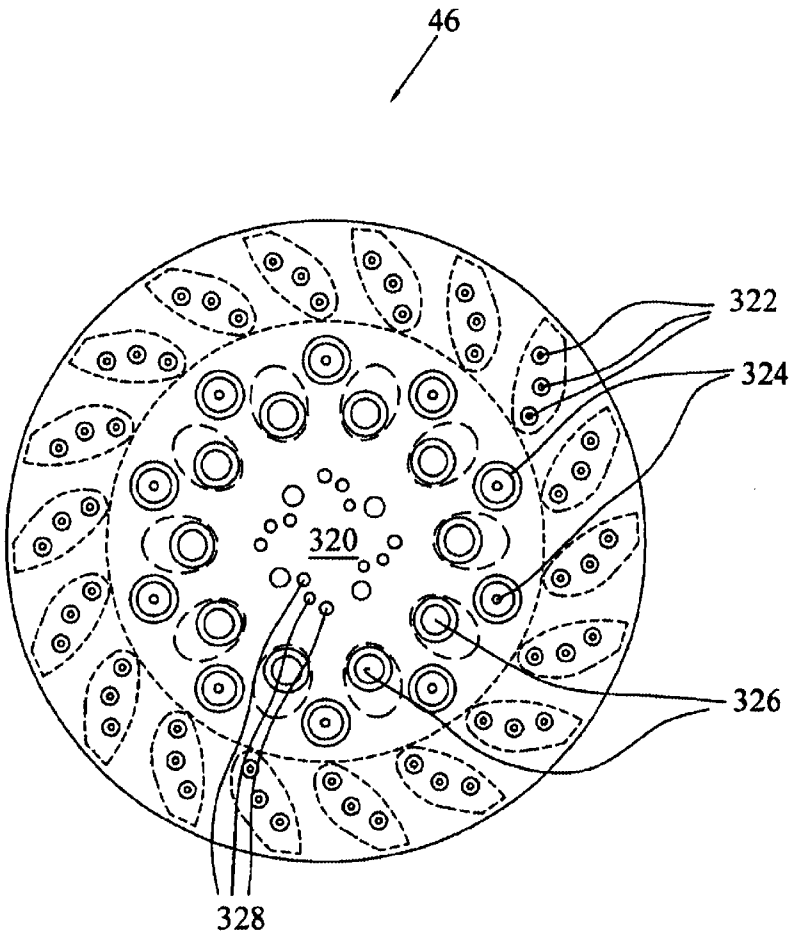
FIG. 25 is a front plan view of the front face plate of either FIG. 23 or 24.

With respect now to FIGS. 23 through 25, the front face plate 46 will be described in greater detail. With respect first to FIG. 25, the front face plate 46 includes a front face 320 having a plurality of water openings, including water spray openings 322, water mist openings 324, aerated spray openings 326, and massage spray openings 328. With reference now to FIGS. 23 and 24, it should be appreciated that each of the different spray openings are confined in separated channels, channels formed by a plurality of inner annular walls. For example, a channel 330 is formed between an outer wall 332 and wall 334, the channel 330 confining the spray openings 322. A channel 336 is formed intermediate wall 334 and 338 to confine the mist openings 324. With reference still to FIG. 23, walls 340 and 338 form channel 342 confining aerated spray openings 326. Finally, an annular wall 344 together with annular wall 340 define an inner channel 346 as will be described herein, while the annular wall 344 defines an inner channel at 348. As shown in FIG. 23, wall 332 includes a plurality of upstanding alignment ribs 350 spatially distributed about the inside diameter of wall 332 and extending above a top surface 352 of wall 332. The outside of wall 332 includes a recess forming a shoulder at 354, the recess also having an O-ring groove at 356. Also as shown best in FIG. 23, internal wall 332 includes flattened portions 358, and the wall 334 includes flattened sections 359. Spring positioning posts 360 are positioned within the channel 330. Within channel 336 are annular rings 362 surrounding the individual openings 324. With respect to upstanding wall 344, it should be appreciated that the wall includes slots 364 forming angular openings between the channel 346 and 348. Finally, centrally disposed within the channel 348 is an upstanding post 370 having a squared top section at 372.

Figure 28:
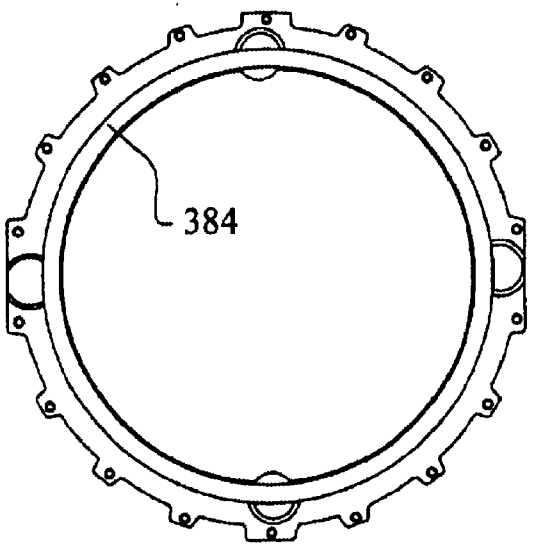
FIG. 28 is a rear plan view of the ring of FIG. 26.
Figure 27:
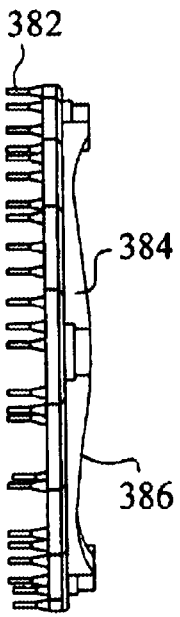
FIG. 27 is a side plan view of the ring of FIG. 26.
Figure 26:
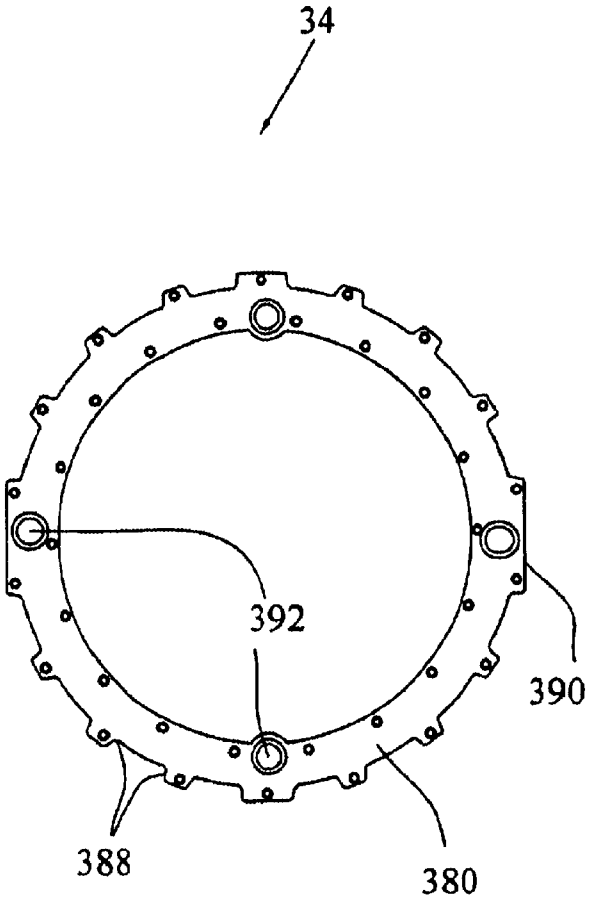
FIG. 26 is a front plan view of the cleaner ring.

With respect now to FIGS. 26 through 28, the cleaning ring 34 will be described in greater detail. The ring generally includes an annular ring portion 380 having a plurality of pins 382 extending therefrom, the pins 382 being disposed in an identical pattern as that of the spray holes 322. The cleaning ring 34 further includes an upstanding cam ring at 384 having a contoured following surface 386. The cleaning ring 34 includes a plurality of extended portions at 388 which carry the outer pin 382 and extended portions 390 having two such external pins 382. Spring receiving cups 392 are positioned extending into the ring 380, for spring loading the cleaning ring 34 as will be described in greater detail herein.

Figures 29, 30, 31, 32, 33:
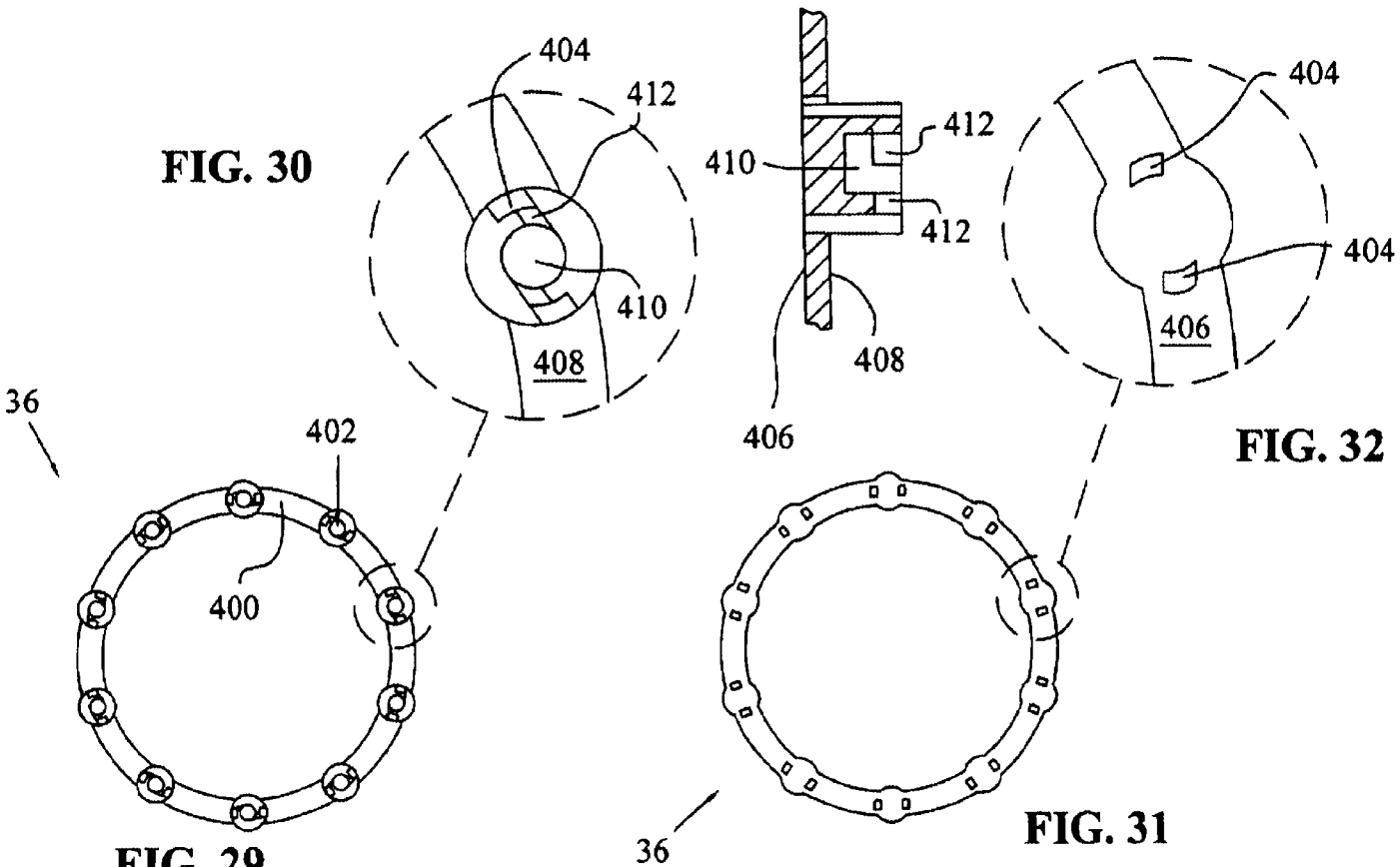
FIG. 29 shows the front face of the atomizer ring.
FIG. 30 shows the enlarged view of one of the apertures of the atomizer ring of FIG. 29.
FIG. 31 shows the rear face of the atomizer ring.
FIG. 32 is the enlarged view of one of the apertures of FIG. 31.
FIG. 33 is a cross-sectional view through lines 33—33 of FIG. 32.
Figure 34:
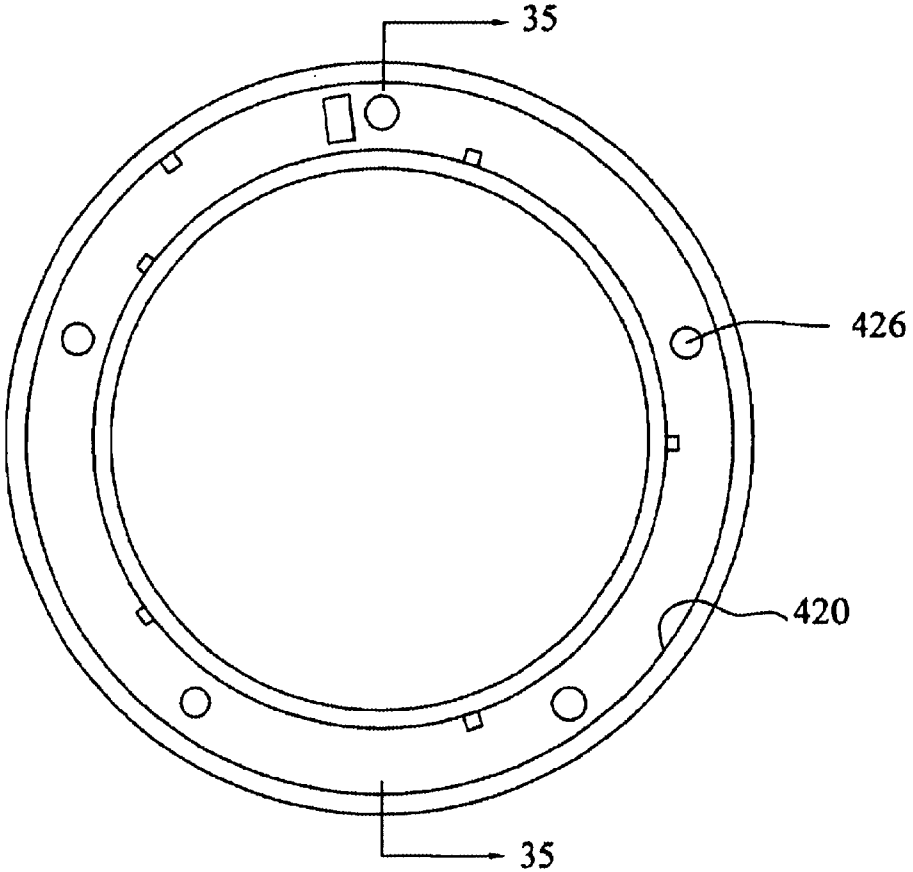
FIG. 34 is a rear plan view of the flow ring shown in FIG. 4.

With respect now to FIGS. 29 through 33, the atomizer ring 36 will be described in greater detail. As shown in FIG. 29, the atomizer ring 36 includes an annular ring portion 400 including a plurality of apertures shown generally at 402. The aperture 402 includes two sector-shaped apertures 404 which extend between a rear face 406 through to a front face 408. Extending into the front face 408 is a central counter bore 410, and adjacent to the front face are radial connecting channels at 412. Finally, as shown in FIG. 4, a cylindrical seal member 414 is associated with the atomizer ring 36 as described herein.

Figure 35:
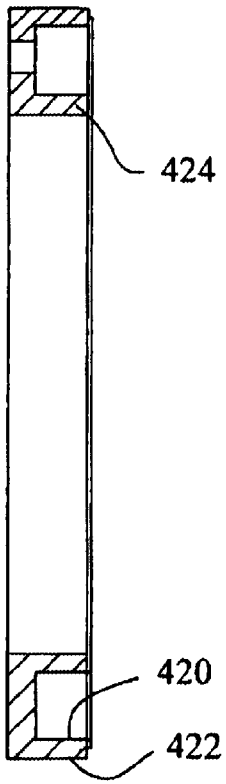
FIG. 35 is a cross-sectional view through lines 35—35 of FIG. 34.
Figure 36:
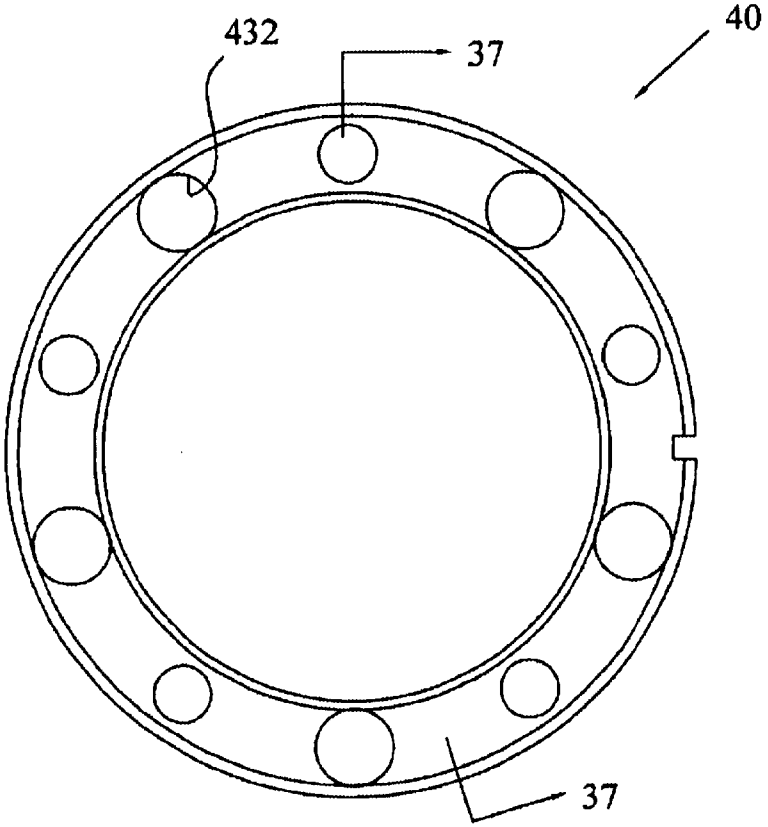
FIG. 36 is a rear plan view of the screen ring shown in FIG. 4.
Figure 37:
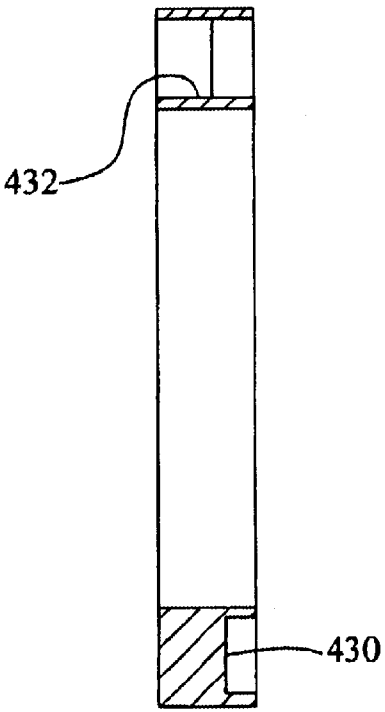
FIG. 37 is a cross-sectional view through lines 37—37 of FIG. 36.
Figure 38:
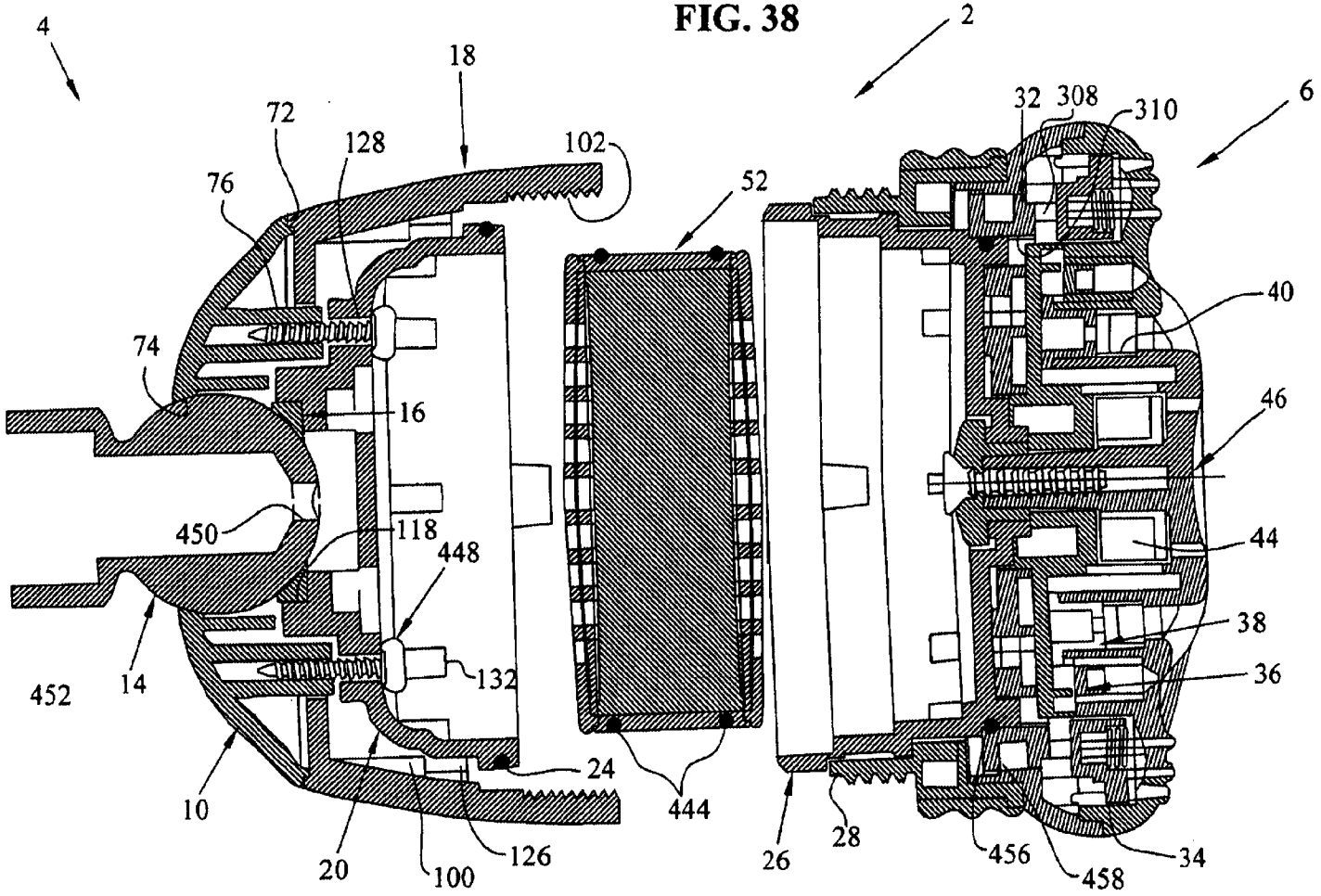
FIG. 38 is an exploded cross-sectional view of the shower head of FIG. 1.

With reference now to FIGS. 34–37, the flow rings 38 and 40 will be shown and described in greater detail. The flow ring 38 includes an annular channel at 420 with a flange portion 422 on the outer perimeter thereof and an inner flange portion 424. Apertures 426 extend downwardly through the bottom of the channel portion as shown in FIG. 35. With reference now to FIGS. 36 and 37, the flow ring 40 is shown having an annular channel 430 having apertures 432 extending therethrough. With respect now to FIGS. 6 and 38, the filter assembly 52 will be described in greater detail. As shown in FIG. 6, the filter body 54 is comprised of an annular ring having a hollow central space 441 for receiving the filter medium 60 and two annular grooves 442 for receiving O-rings 444 (FIG. 38). The filter medium 60, while shown as a disk, is actually copper-zinc granules which in the preferred embodiment is material KDF 55 as sold by KDF Fluid Treatment in Three Rivers, Mich. As also shown in FIG. 6, the intermediate caps 56 include through holes 446 for allowing the flow of water through the caps and through the medium. End caps 58 include openings 448 similar to openings 446 and also include a mesh screen 450 positioned on the inside of the end caps 58. It should be appreciated that the filter 52 can be assembled by completing one of the intermediate caps 56 and end cap 58 filling the filter body 54 with the granules and completing the assembly of the other end with the intermediate cap and end cap 56 58. It should also be appreciated that the assembly could either be completed using an epoxy to retain the end caps in a position, or could alternatively be bonded by way of an ultrasonic welding process which would actually melt the components together.

With reference now to FIGS. 2, 3–5 and 38, the assembly of the shower head tube will be described in greater detail. To assemble the rear housing portion 4, the pipe spigot ball joint 14 is first inserted through opening 70 until the ball portion resides against surface 74 (FIG. 8) of the rear housing plate portion 10. Seal member 16 can thereafter be positioned within counter bore 118 (FIG. 12) and housing skirt portion 18 positioned against the recess 72 of the rear housing plate portion 10. The rear filter retainer 20 is thereafter positioned within the housing skirt portion 18 with the ribs on 126 positioned in the corresponding slots 98. The combination of the housing skirt portion and rear filter retainer are now positioned against the rear housing portion 10, such that the counter bores 130 reside over posts 76. This also places recessed shoulder 72 (FIG. 8) within the recessed surface 86 (FIG. 10). With the rear filter retainer 20 aligned to the rear housing plate portion 10 as described, fasteners 448 can be positioned through apertures 128, and can be aligned with posts 76 such that the fasteners 448 will draw the rear filter retainer 20 and rear housing plate portion 10 together, trapping between them, the pipe spigot ball joint 14 and the housing skirt portion 18. It should be appreciated that an in-line filter such as item 12 can be positioned within the threaded counter bore 452 of the pipe spigot ball joint 14 at any time.

With reference now to FIGS. 3–5 and 38, the assembly of the front housing portion 6 will be described in greater detail. The front housing portion 6 is comprised of three subassemblies, the subassembly including the components of FIG. 3, of FIG. 4, and of FIG. 5. With respect first to FIG. 3, the thread ring 28 is first received over the front filter retainer 26, such that the front leading edge 266 abuts the forwardly facing shoulder 158. This places the inner diameter 275 against the outer diameter section 156 with the O-ring groove 164 positioned proud of the inner edge 274 of the threaded ring 28. O-ring 456 (FIG. 38) can either be assembled at this stage or prior to the assembly of the threaded ring 28. The outer ring 30 can now be slidably received in the front end of thread ring 28 with diameter 276 residing within diameter 272 until the front edge 278 abuts the shoulder 274. The seal retaining ring 32, together with its associated V-ring seal 458 can now be slidably received within the assembly of items 26, 28 and 30 such that the V-ring seal resides against inner diameter 279 of outer ring 30, and wherein inner diameter 310 of the seal retaining ring 32 is positioned over O-ring seal 456 as best shown in FIG. 38. This also places openings 300 in the seal retainer 32 within the locating lugs 186 keeping the seal retaining ring 32 fixed relative to the forward filter retainer 26.

With respect now to FIGS. 4, 23 and 24, another subassembly of the front housing portion 6 will be described in greater detail. It should be appreciated, however, that all of the components shown in FIG. 4 are assembled into the back face of the front face plate as to be described. Also as previously described, and with reference again to FIG. 23, the front face plate 46 is comprised of a plurality of radially disposed channels, that is, inner channel 348, channel 342, channel 336, and outer channel 330. As shown in FIG. 4, the massage wheel 44 can be assembled to the back side of the face plate 46, and is assembled such that baffle 472 is leading, with the aperture 474 being placed over central post 374. This positions the baffle 472 adjacent to openings 328 and positions veins 470 inside of wall 344. The screen 42 can then be placed within channel 342 and flow ring 40 positioned behind the screen 42 in channel 342. Flow ring 38 is then positioned against flow ring 40 also fitting within channel 336 as shown in FIG. 38. It should be appreciated by comparing FIGS. 34 and 36 that flow ring 38 includes five apertures, whereas flow ring 40 includes ten apertures. The two rings are aligned or polarized via a polarizing rib 478 on the inside of wall 338 such that five of the apertures of flow ring 40 are aligned with the five apertures of flow ring 38, yet the two rings are profiled such that they abut along their front faces, that is, flow ring 38 does not fit down into the notch 430, but rather the channel is left open between the two rings. With respect again to FIGS. 4 and 23, seal members 414 are positioned in radial walls 362 and the atomizer ring 36 is thereafter placed within channel 336, such that apertures 410 are aligned with individual openings 324 and the front face plate 46. Finally, springs 460 can be positioned over posts 360 within channel 330 and cleaning ring 34 positioned in channel 330. The ring 34 is aligned such that extended portions 390 are aligned with flattened portions 358, and such that the spring receiving cups 392 are positioned over the springs 460 and over the posts 360. This aligns individual pins 382 with individual apertures 322.

With respect now to FIG. 5, the subassembly of the front and rear flow director plates 48, 50 will be described. It should be appreciated that it is desirable to bond the two plates 48 and 52 together, and in the preferred embodiment of the invention, the two plates are ultrasonically welded together. Thus, the front plate 48 is positioned adjacent to the rear plate 50, such that the openings 208 are aligned with the key hole partitions 219. This positions the outer periphery 192 inside the lip 248 and positions back face **191*b* against the tapered rib 246. It should be appreciated to one skilled in the art of ultrasonic welding that an ultrasonic horn can now be placed against the front flow director plate 48 to ultrasonically bond the two components 48, 50** together.

The combination of the two flow director plates 48 and 50, can now be positioned also in the back side of the front plate 46, whereby opening 198 is positioned over the central post 374 and with the flattened portions 194, 252 positioned within and against the flats 359 (FIG. 23). The subassembly as previously described with relation to FIG. 3 can now be assembled to the subassembly of FIG. 4 as previously described including the flow director plates, such that alignment lug 256 (FIG. 22) is positioned in semicircular channel 182. Front face plate 46 is also polarized to the outer ring 30 to prevent rotation therebetween. As shown in FIG. 3, the insert 480 can now be inserted into the front filter retainer 26 to reside within the opening 170 (FIG. 4) with the squared opening 484 being positioned over the corresponding square post section 372 (FIG. 24) and a fastener 482 inserted which threads into the post 374 to retain the entire assembly together. It should be appreciated that this places the camming lugs 308 adjacent to and against the contoured follower surface 386 (FIG. 27).

The final assembly of the shower head, that is, to assemble the rear housing portion 4 and front housing portion 6 together, includes insertion of the filter subassembly 52, and then the alignment of members **136*a*, 136*b* with their respective openings in the front filter retainer 26. The housing portions 4 and 6 can be held together by threading the threaded portion 268 of the thread ring 28 into complementary threaded portions 102 of housing skirt 18. It should be appreciated that from the foregoing the front face plate 46, together with flow rings 38, 40, atomizer ring 36, cleaner ring 34, and flow director plates 48, 50 can be rotated relative to the remainder of the assembly, and primarily rotatable relative to the forward filter retainer 26** as described below.

The operation of the shower head will now be described. With respect first to FIGS. **39*a* and 39*b*, the front face of the front filter retainer 26 is reproduced as well as the top plan view of the rear flow director plate 50. However, shown in phantom in FIG. 39*b* are the locations of stop lug 256, which is located on the back side of flow director plate 50; as well as openings 208, 210, and 212, which are located on the front flow director plate 48, but are illustrative for the discussion of the water flow patterns. It should also be appreciated that the two openings 208 are positioned at a radial distance $R_1$, opening 210 is positioned at a radial distance of $R_2$, and opening 212 is located at a radial distance of $R_3$. It should also be appreciated from a comparison of FIGS. 39*a* and 39*b*, that the openings 222, 226, 230, 234, and 238 are all positioned at a radial distance of $R_4$, which is the identical radial distance of apertures 180*a* and 180*b* in the filter retainer member 26. It should also be appreciated, as described above, that lug member 256 resides within the semicircular channel 182, such that rotation of the flow director plates 48 and 50 relative to filter retainer 26 will align various of the openings 222–238 with openings 180*a*, 180*b*, and that the rotation can exist between the extremes of contact between lug 256 and surface 183, and lug 256 with surface 183*b***. It should also be appreciated that the water will be directed in various directions and channels given the various radial openings through which the water is optionally directed.

Figure 41A:
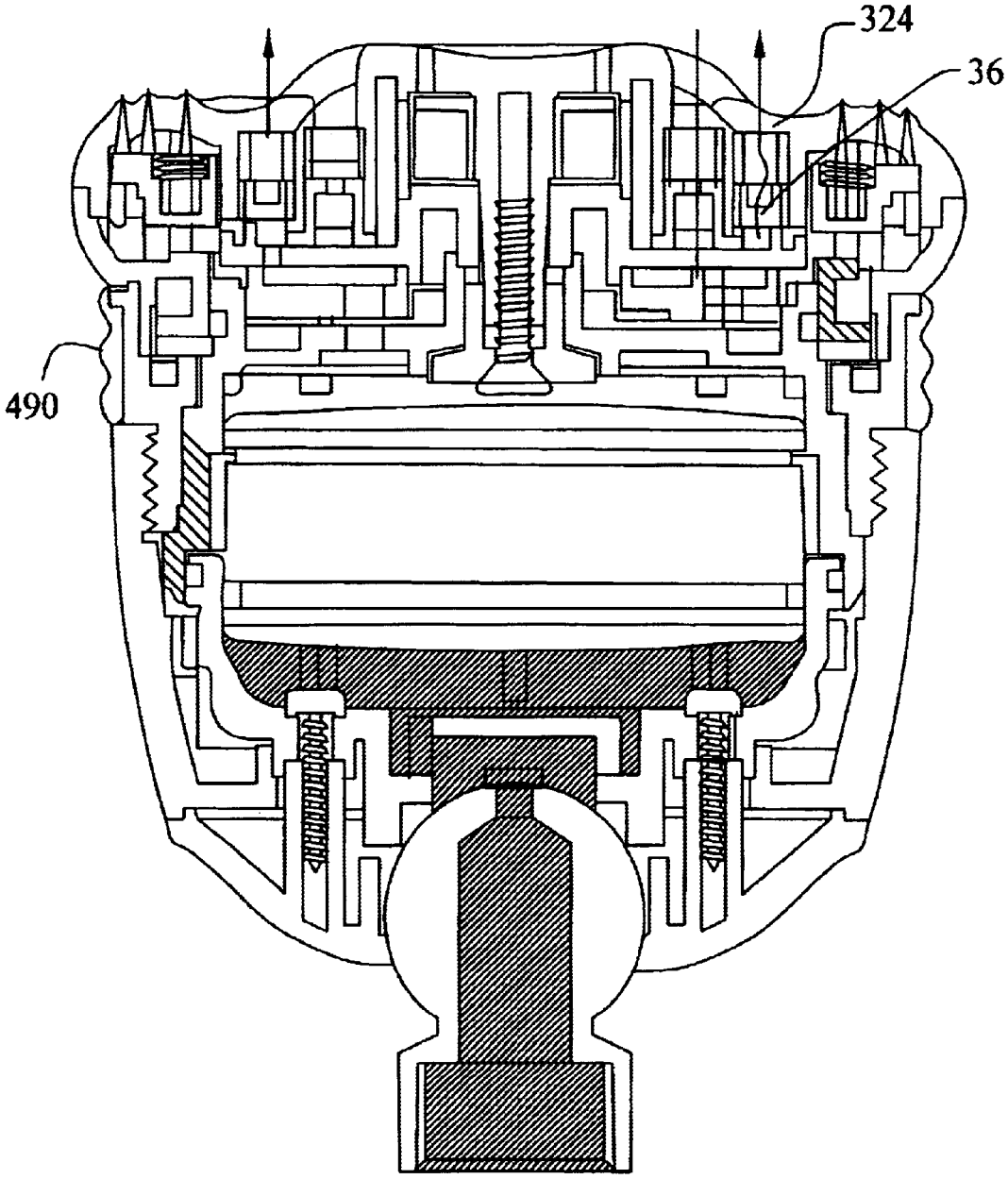
FIGS. 41*a*–41*e* show a corresponding cross-sectional view of the entire shower head in respective corresponding positions to the positions of the flow director plates according to FIGS. 40*a*–40*e*.

With respect now to FIG. **40*a*, the flow director plate 50 is shown superimposed over the filter retainer 26 such that lug member 256 is in the counter-clockwise-most position, where lug 256 will abut surface 183*a*. In this position, opening 234 in the flow director plate 50 will be aligned with the opening 180*a* in the filter retainer member 26. Thus, the water flow is diagramatically shown as flowing into opening 234 and through opening 212. It should be remembered that, because of the ultrasonic bonding between the flow director plates 48 and 50, each of the channels are closed compartments such that flow can be confined to various openings. With reference again to FIG. 24, the radial distance of channels 346, 342, and 336, are shown respectively as $R_1$, $R_2$, and $R_3$. Thus, as the water flows out of aperture 212, and as aperture 212 is also at a radius $R_3$, in this position water flow is directed into channel 336. This position also corresponds with FIG. 41*a*, showing the water flow through the atomizer ring and through openings 324** as will be described further herein.

Figure 39A:
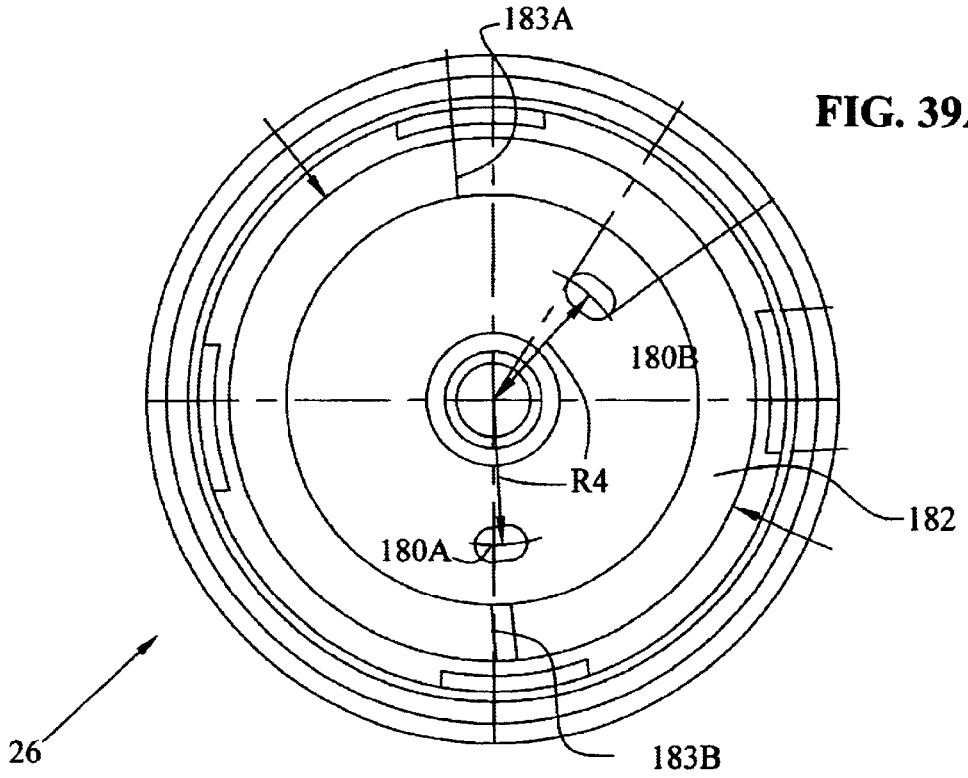
FIG. 39*a* is identical to that of FIG. 16, emphasizing the radial locations of the water openings.
Figure 39B:
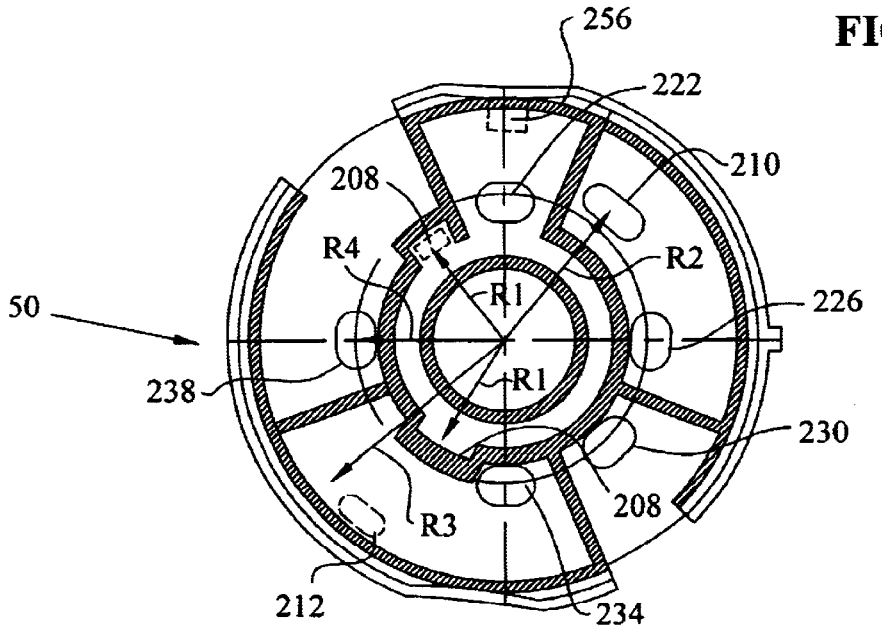
FIG. 39*b* is identical to that of FIG. 20, emphasizing the radial locations of the water openings, and including in phantom the locations of the water openings from the outer water flow director plate of FIG. 19.

With respect now to FIG. **40*b*, flow director plate 50 is shown rotated in the clockwise position to its next detented position, whereby openings 222 and 234 align with openings 180*b* and 180*a*, respectively (FIG. 39*a*). This causes water to flow through opening 180*b* into opening 222 and thereafter into chamber 220 and through apertures 208 in front flow director plate 48. This also causes water flow through opening 180*a* into opening 234 and through the side opening 240 of flow director plate 50. As noted from a comparison of FIGS. 24 and 39B, openings 208 are radially located at distance $R_1$, as is channel 346. Thus, in this position of flow director plates 48, 50, this causes water flow from openings 208 into channel 346, and from opening 240 into channel 330, thus directing water flow through apertures 328 and 322 of the front face plate 46. This also corresponds with FIG. 41***b*.

Figure 40A:
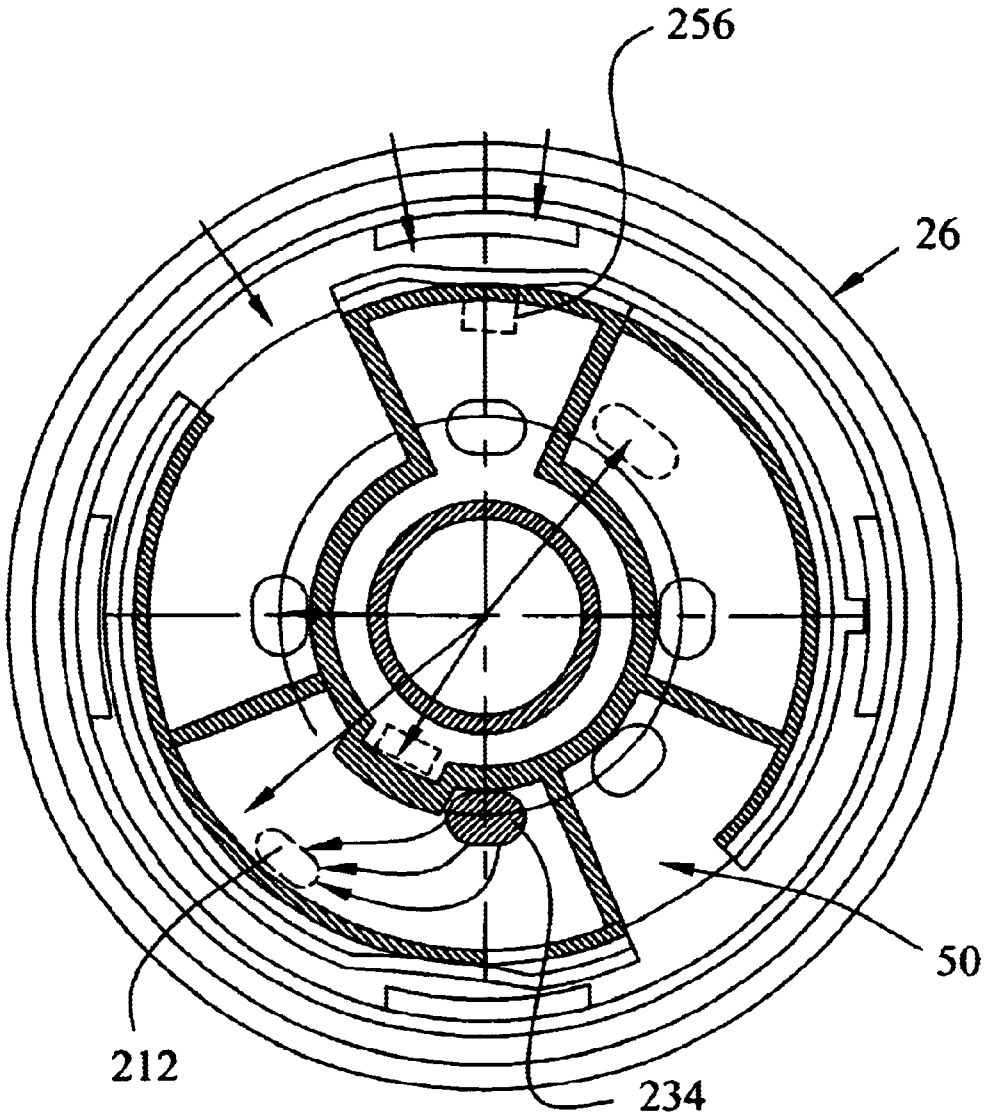
FIGS. 40*a*–40*e* show various locations of the inner and outer water flow director plates rotated into various positions showing the water flow patterns according to those positions.
Figure 40B:
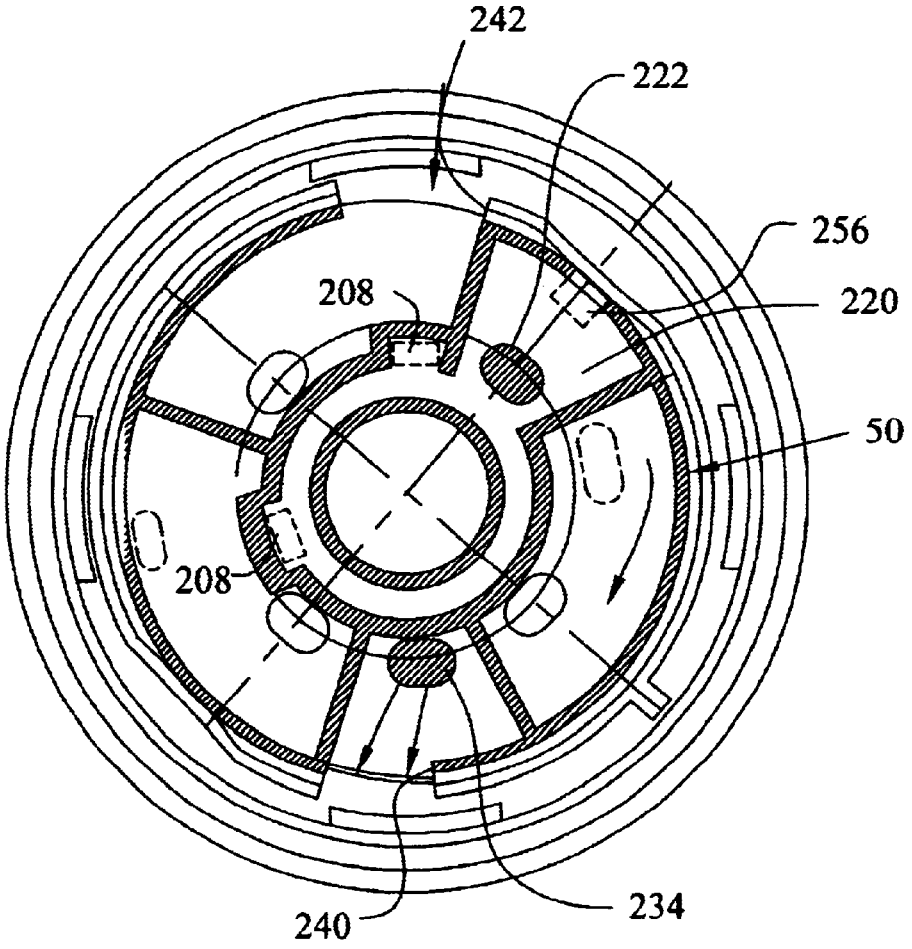
Figure 40C:
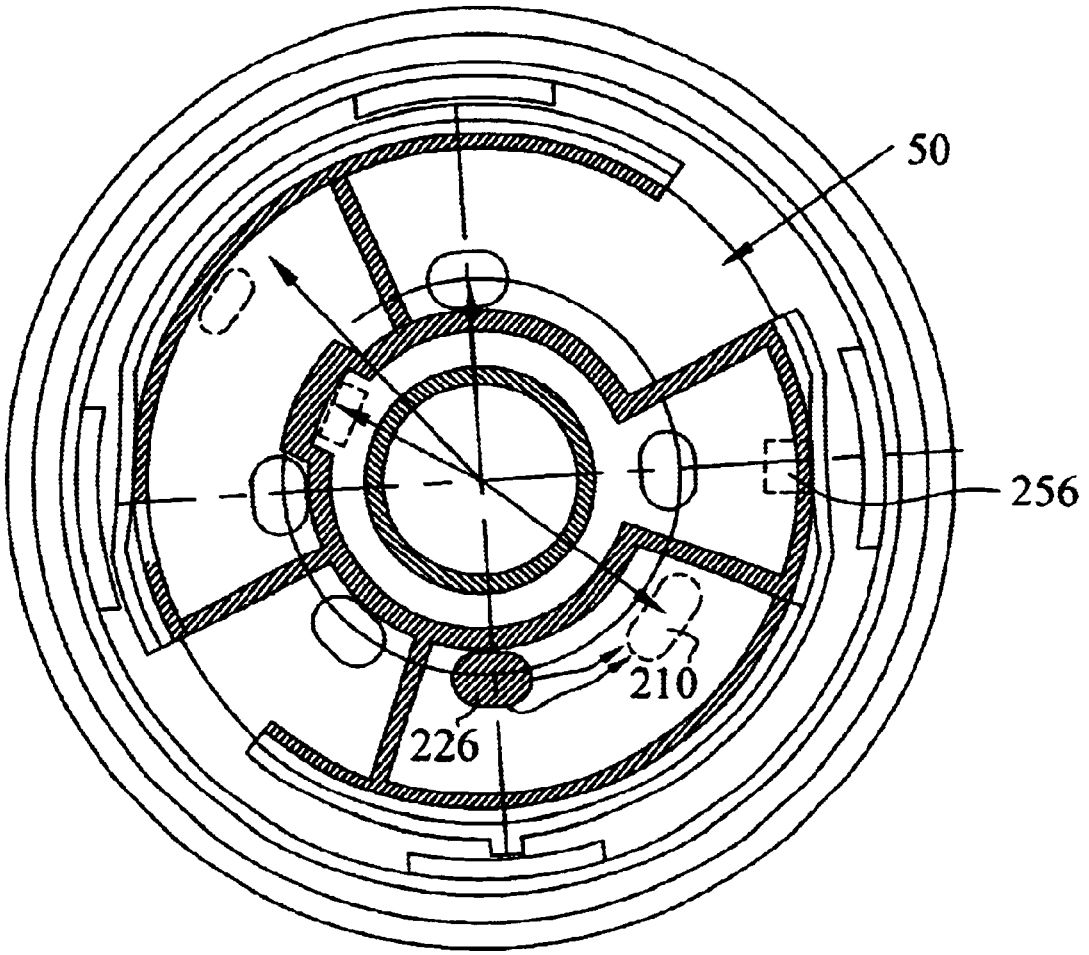

With respect now to FIG. 40*c*, flow director plate 50 is again rotated as shown by the location of lug 256, to a position where opening 226 in flow director plate 50 aligns with aperture 180*a* in the filter retainer 26. This causes water flow from opening 226 through opening 210 in the front flow director plate. As opening 210 is located a radial distance $R_2$, water is directed to channel 342 and through openings 326, as shown in FIG. 41*c*, and further described herein.

Figure 40D:
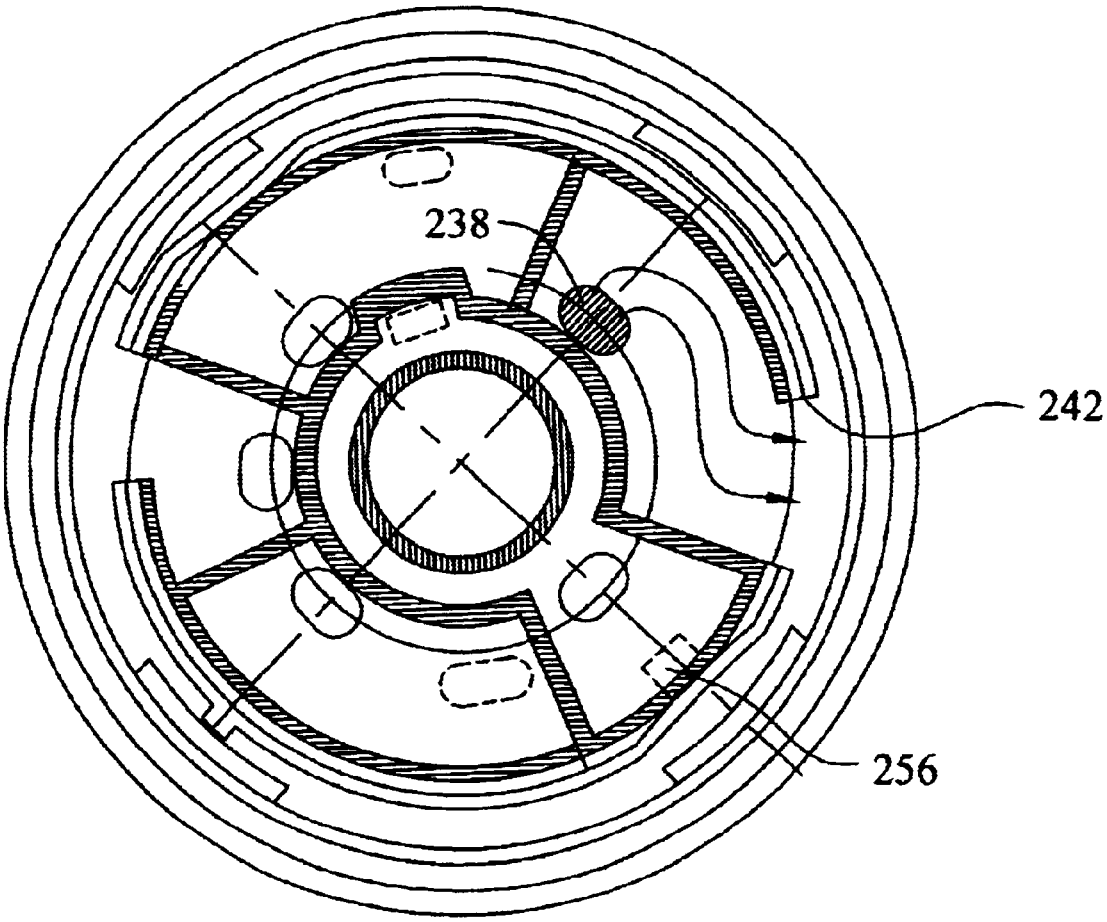

With respect now to FIG. 40*d*, the flow director plates 48, 50 are again rotated to a new position as shown by the location by lug 256. In this position, opening 238 of plate 50 is aligned with opening 180*b* of the filter retainer 26 to direct the flow of water out through the side opening 242 of plate 50. This causes the flow of water into passageway 330 and through openings 322, also as shown in FIG. 41*d*.

Figure 40E:
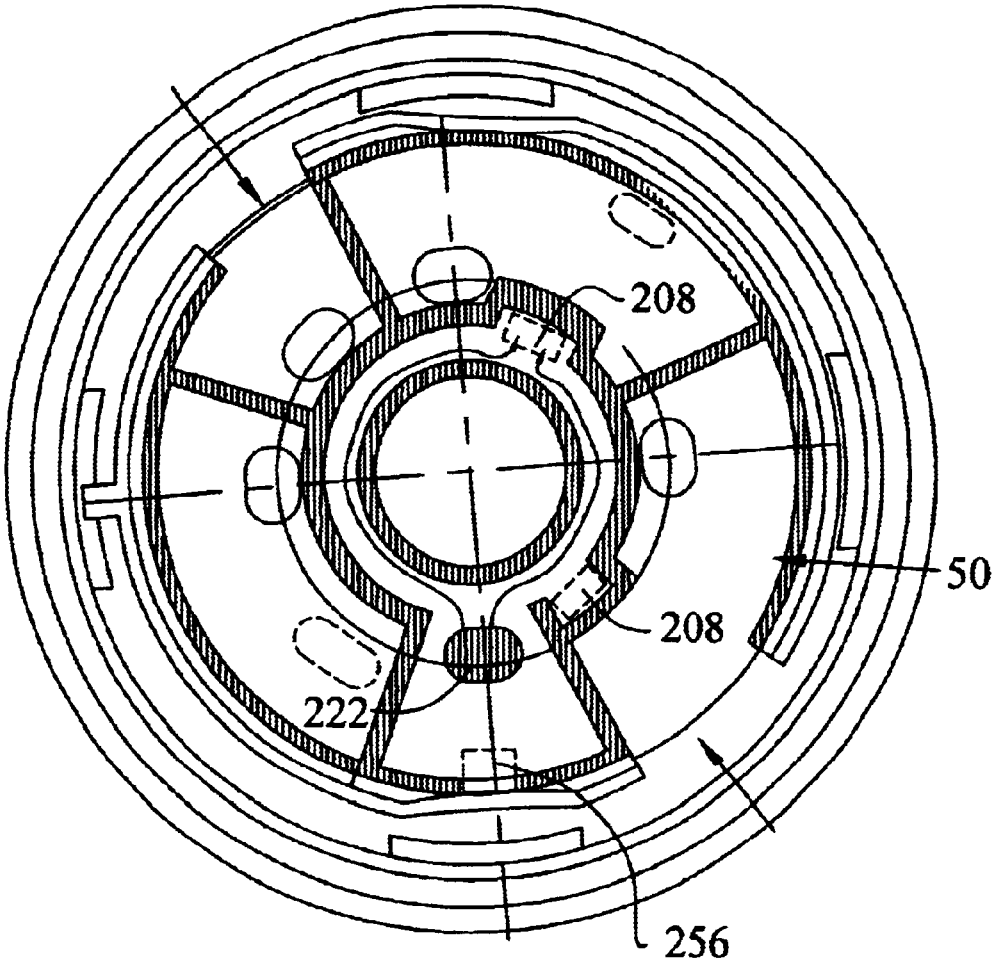

Finally with respect to FIG. 40*e*, the flow director plates 48, 50 are shown rotated into their clockwise-most position, where lug 256 would abut shoulder 183*b* (FIG. 39*a*). In this position, opening 222 will align with opening 180*a* (FIG. 39*a*) to cause the flow of water through opening 222 and into openings 208. This causes the flow of water into channel 346 only.

The different modes of operation will now be described relative to FIGS. 41*a*–41*e*. When in the position of FIGS. 40*a*, 41*a*, water flows into atomizer ring 36 through apertures 404 and is then directed through radial passages 412 into the chamber 410. This radial swirling causes an atomization of water thereafter vaporizing the water through apertures 324.

Figure 41B:
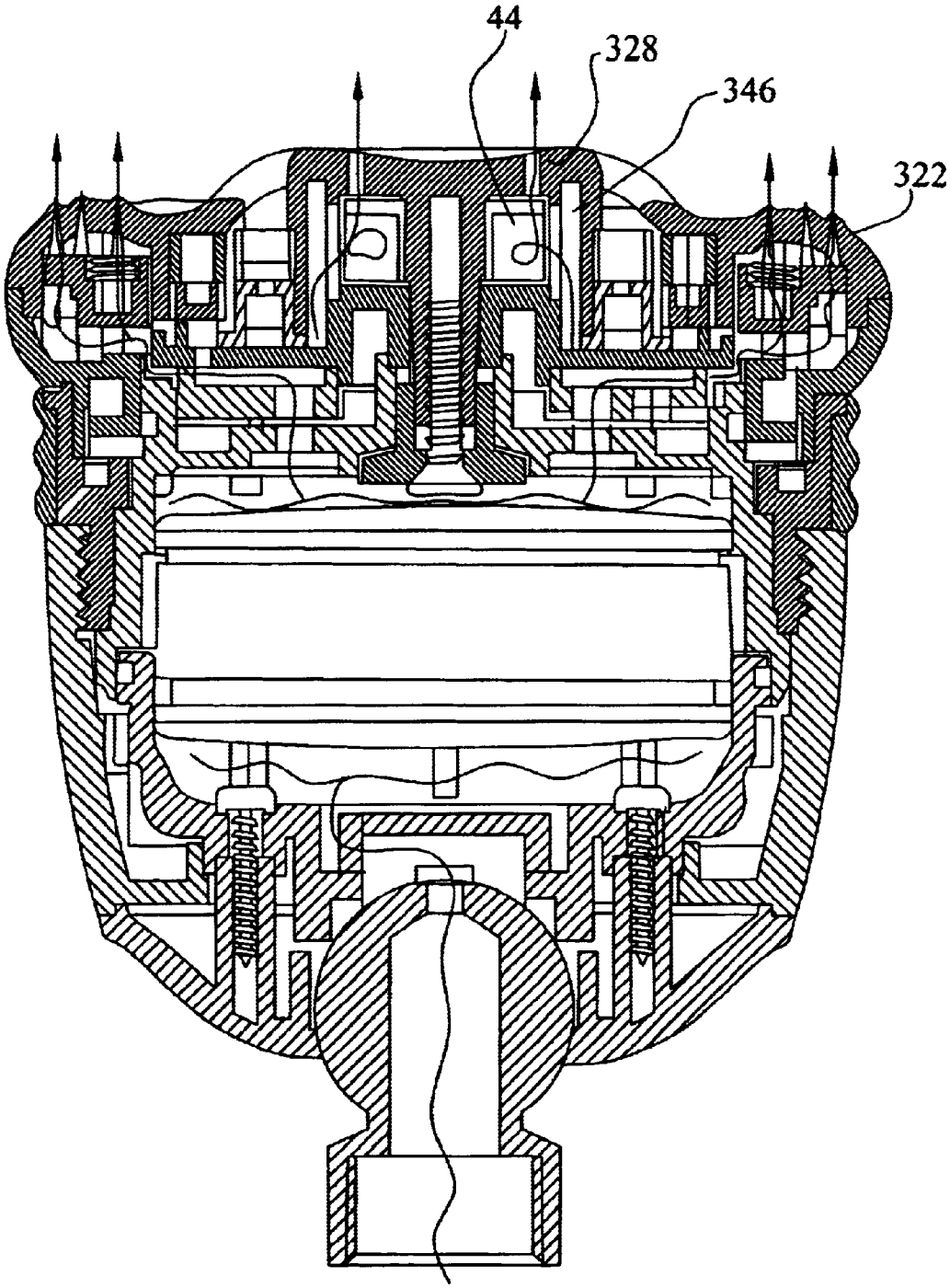
Figure 41C:
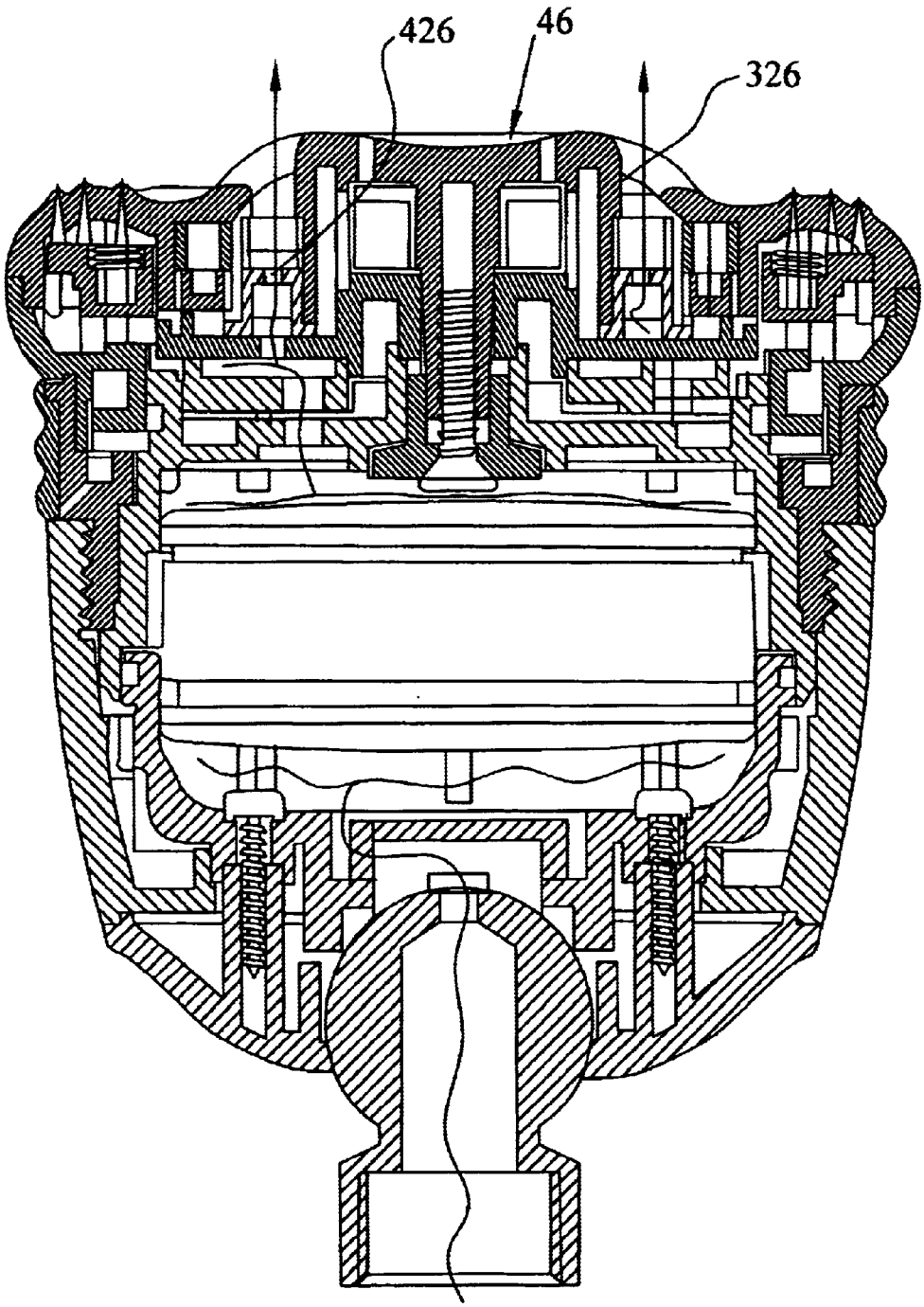
Figure 41D:
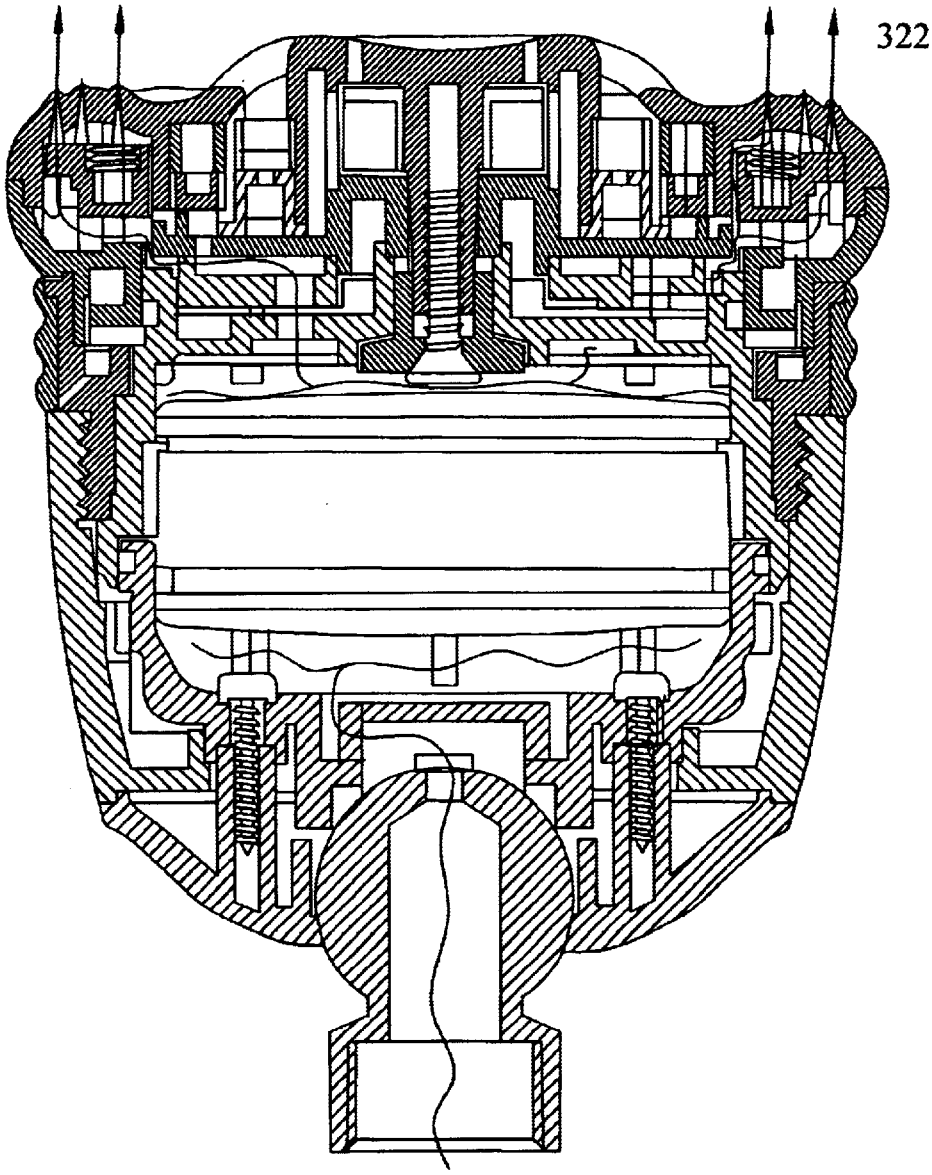

When the shower head is in the position of FIGS. 40*b* and 41*b*, water is directed to massage wheel 44 and through openings 328. With reference again to FIG. 23, water directed to channel 346 causes the water to be directed through channels 364 and against the veins causing the massage wheel to rotate. The baffle 372 (FIG. 4) causes an oscillation of the spray pattern through openings 328. In the position of FIG. 41*b*, water is also directed radially outward as described above and through the standard spray through openings 322.

When in the position of FIG. 40*c* or 41*c*, water is directed through flow director rings 38, 40 and due to the enlarged expansion area downstream of openings 426, that is, into the channel 430 and through the enlarged holes 432 (FIGS. 36 and 37), the water is aerated and takes on added volume. This spray pattern exits through openings 326 in the faceplate 46.

Figure 41E:
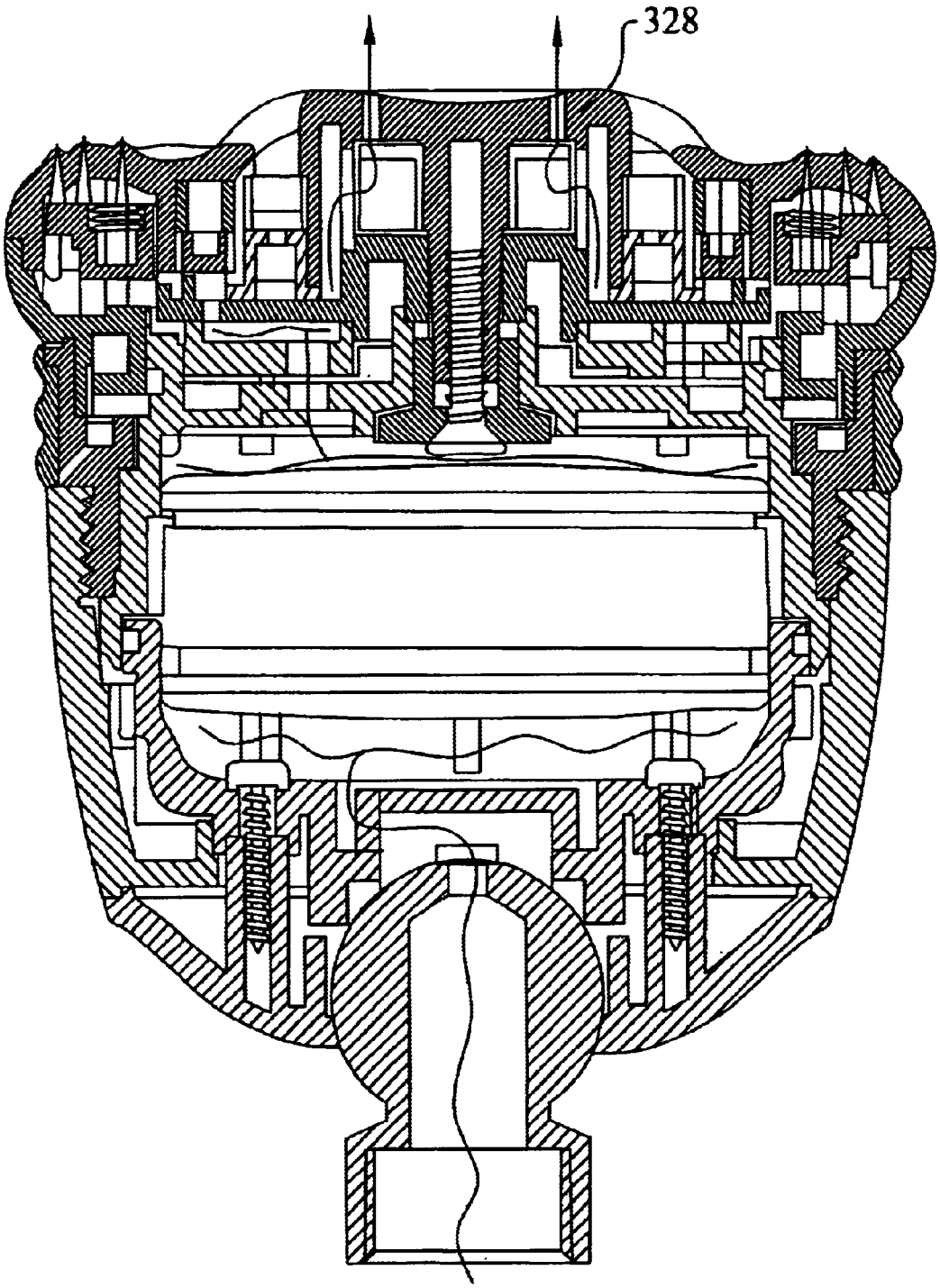

In the position of FIG. 40*d* or 41*d*, water is directed only through openings 322, whereas in the position of FIG. 40*e* or 41*e*, water is directed only through the massage wheel and through openings 328.

Figure 42:
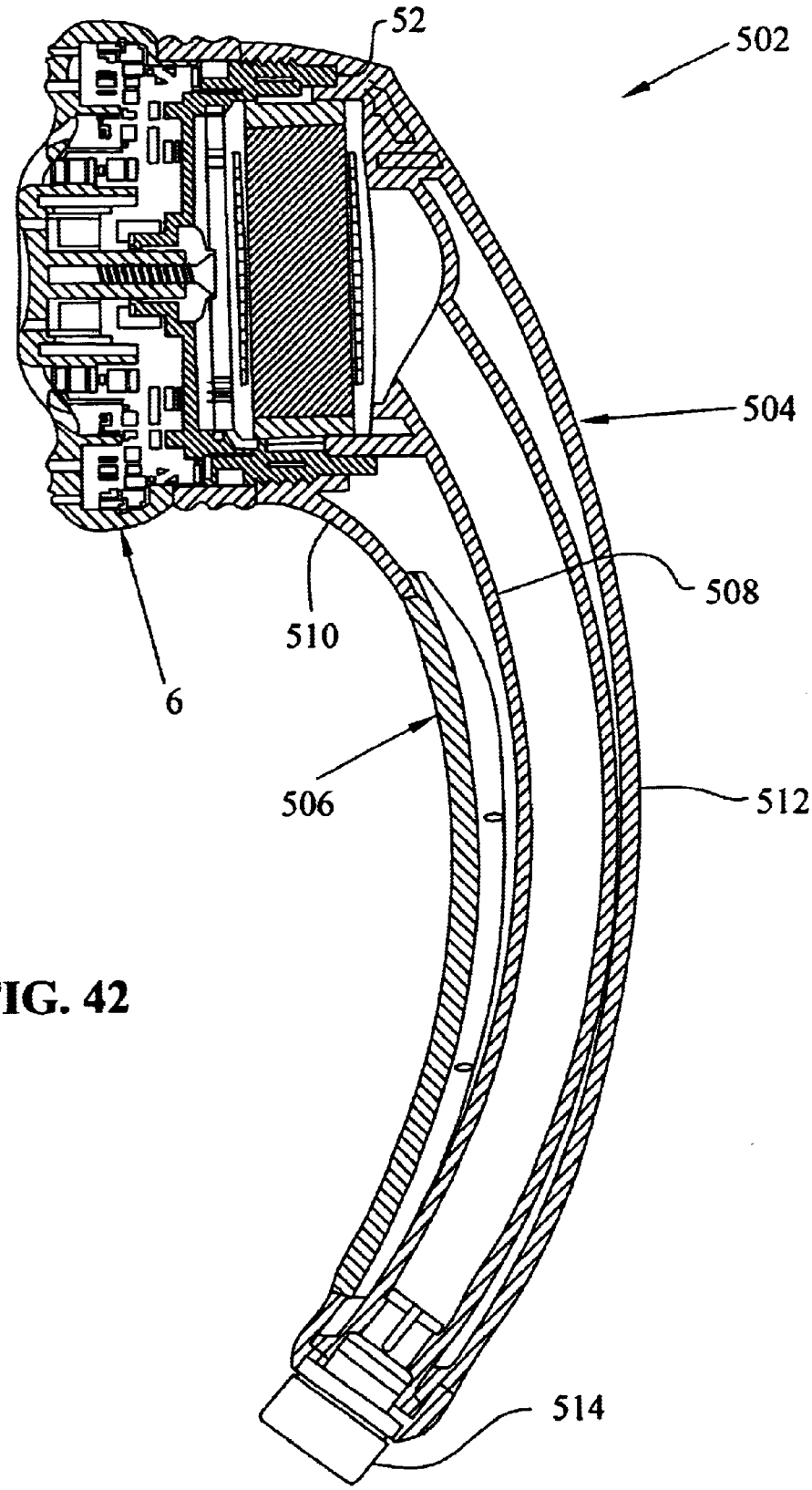
FIG. 42 shows a cross-sectional view of a second embodiment of the invention.

As shown best in FIG. 41*a*, preferably a rubber grip ring, such as 490, is positioned over the thread ring 28 to assist in threading the front and rear housing portions together. It should also be appreciated from the foregoing that the various positions shown from FIGS. 40*a* through 40*e* are detented positions by way of engagement of detent member 306 (FIG. 3) within one of the detent slots 284 of ring 30. It should also be appreciated that when the spray mode is changed, for example, between positions 40*a* to 40*b*, the contoured cam surface 386 engages the camming lobes 308 causing axial movement of the pins 382 into openings 322 of the front face plate 46. This cleans any dirt or other deposits such as calcium caused by hard water out of the openings 322 for a consistent spray pattern. It should be appreciated that a full cycle of the cleaning ring takes place between the detented positions. Also advantageously, the user, to replace the filter need only unscrew the front housing 6, replace the filter assembly 52, and then replace the front housing portion FIG. 42 shows a cross-sectional view of a second embodiment of the invention which is profiled as a hand-held wand 502. As shown in FIG. 42, it should be understood that the identical front housing portion 6 which has been described previously can be incorporated into the wand 502. A rear skirt portion 510 (which is analogous to threaded portion 18) and is attached to the outer housing portion 512 by way of fasteners. An inner tube 508 is also positioned internally of the outer housing 512 and includes a threaded fitting 514 to be fitted to a flexible hose as is common in the art.

I claim:

1. A shower head for spraying water on a user, the shower head comprised of a front housing portion having a plurality of water spray openings, and a rear housing portion which receives incoming water from a source, and an integral filter positioned intermediate said front and rear housing portions, said filter being defined as a cylindrical canister and filled with a filter medium comprised of copper-zinc crystals.

2. The shower head of claim 1, wherein the rear housing portion has a rear port for receiving water, said rear port having pipe threads for fixed connection with a water supply.

3. The shower head of claim 1, wherein the rear housing portion includes a handle portion, and an elongate flexible hose for connection with a water supply, whereby the handle and shower head can be hand-held.

4. The shower head of claim 1, wherein said plurality of water spray openings are profiled in a plurality of spray patterns.

5. The shower head of claim 4, further comprising a rotatable water flow director, which is rotatable to direct water to areas to define said spray patterns.

6. The shower head of claim 1, wherein said rear housing portion comprises a rear filter retainer having a water flow inlet to said filter, and said front housing portion includes a front filter retainer having a water flow outlet from said filter.

7. A shower head for spraying water on a user, the shower head comprising a plurality of water spray openings in a front face plate of said shower head and a plurality of channels on a rear side of said front face plate, said openings being profiled to define different spray modes operable by rotating said front face, said shower head having therein a rotatable water flow director which rotates with said front face to direct water to various channels, and said water flow director directing water to various spray openings to vary the spray mode.

8. The shower head of claim 7, wherein said channels are defined as concentric channels of various radii.

9. The shower head of claim 8, further comprising an internal wall having at least one opening therethrough, and said water flow director has a plurality of openings, whereby rotation of said water flow director aligns at least one of said water flow director openings with said internal wall opening to direct the water flow.

10. The shower head of claim 9, wherein said water flow director is comprised of a plate, having said plurality of openings adjacent to said wall, and having internal passageways communicating with apertures adjacent to said channels, with an aperture for each channel.

11. The shower head of claim 10, wherein said wall includes more than one opening, and wherein a plurality of said water flow director openings can be aligned with said internal wall openings, whereby a plurality of spray modes operate simultaneously.

12. The shower head of claim 7, further comprising an internal filter positioned adjacent to said internal wall, whereby water is directed through said filter and then through said internal wall opening.

13. A shower head for spraying water on a user, the shower head comprising a plurality of water spray openings in a front face plate of said shower head, said openings being profiled to define at least four different spray modes operable by rotating said front face, said shower head having therein a rotatable water flow director which rotates with said front face, said water flow director directing water to various spray openings to vary the spray mode.

14. The shower head of claim 13, wherein said face is rotatable to a combined spray mode where said water flow director simultaneously directs water to openings associated with at least two different spray modes.

15. The shower head of claim 13, wherein the spray modes include a standard shower spray mode, a massaging or pulsing spray mode, an aerated spray mode with an enlarged opening to aerate and add volume to the water, and a water mist mode wherein the water flows through an atomizer ring to vaporize the water.

16. A shower head for spraying water on a user, the shower head comprising a plurality of spray openings in a front face plate thereof, a cleaning ring positioned behind said face plate with a plurality of cleaning pins aligned with said plurality of spray openings, and a camming surface positioned on said cleaning ring, said front face plate and said cleaning ring being rotatable, whereby said cleaning ring is cammed forward, projecting said cleaning pins through said spray openings.

17. The shower head of claim 16, further comprising a plurality of springs, spring loading said cleaning ring in the fully rearward position.

18. The shower head of claim 17, wherein the front faceplate has a plurality of detented positions, and the cam is profiled to traverse a complete cycle between adjacent detented positions.

19. A shower head for spraying water on a user, the shower head comprising:

a front face plate having a plurality of spray openings defining a plurality of spray patterns, and said front faceplate being rotatable to vary the spray patterns;

a water distributor directing the flow of water between select spray patterns; and a filter positioned upstream of said front face plate to filter water prior to exiting from said face plate; and a cleaning ring positioned behind said faceplate having cleaning pins which are moved into and out of at least some of said openings, upon rotation of said faceplate.

20. A shower head for spraying water on a user, the shower head comprising a plurality of water spray openings in a front face plate of said shower head, said openings being profiled to define different spray modes operable by rotating said front face, said shower head having therein a rotatable water flow director which rotates with said front face, said water flow director directing water to various spray openings to vary the spray mode, and said shower head having rotational limitations defined by a lug encountering stopping surfaces in an arced-shaped channel through which the lug travels while said front face is rotated.

21. A shower head for spraying water on a user, the shower head comprising a front housing portion having a plurality of water spray openings, a rear housing portion which receives incoming water from a source, and an integral filter positioned intermediate said front and rear housing portions, said integral filter including a pair of end caps, both of said end caps having water passage openings.

22. The shower head of claim 21, further including at least one intermediate cap positioned between a filter medium and one of said end caps, said intermediate cap including water passage holes.

23. The shower head of claim 22, further including a mesh screen located between said intermediate cap and said one end cap.

24. The shower head of claim 23, further including another intermediate cap and another mesh screen located between the filter medium and said other end cap.

25. A shower head for spraying water on a user, the shower head comprising a front housing portion having a plurality of water spray openings, a rear housing portion which receives incoming water from a source, and an integral filter positioned intermediate said front and rear housing portions, said integral filter including a filter body having grooves around an outer circumference thereof, profiled to receive a sealing member.

26. The shower head of claim 25, further including a filter retainer and a sealing member, said filter retainer having an upper portion and a lower portion, each of said portions of said filter retainer having a water passage therethrough, said seal member being positioned in said groove and sealed against an inner diameter of said filter retainer.

27. The shower head of claim 26, wherein said filter retainer is removable from said shower head.

28. The shower head of claim 26, wherein said filter retainer includes at least one groove around an outer circumference thereof profiled to receive a sealing member.

29. The shower head of claim 26, wherein both of said upper and lower portions of said filter retainer include filter stand-offs.

30. The shower head of claim 26, wherein one of said upper or lower portions of said filter retainer has polarizing lugs and said other portion of said filter retainer has polarizing openings for receiving said polarizing lugs.

* * * * *